US006828717B2

(12) United States Patent
Yamamoto et al.

(10) Patent No.: US 6,828,717 B2
(45) Date of Patent: Dec. 7, 2004

(54) ELECTRON GUN HAVING SHORT LENGTH AND CATHODE-RAY TUBE APPARATUS USING SUCH ELECTRON GUN

(75) Inventors: Yoji Yamamoto, Nishinomiya (JP); Satoru Nakagawa, Takatsuki (JP); Mika Yamagishi, Takatsuki (JP)

(73) Assignee: Matsushita Electric Industrial Co., Ltd., Osaka-fu (JP)

( * ) Notice: Subject to any disclaimer, the term of this patent is extended or adjusted under 35 U.S.C. 154(b) by 27 days.

(21) Appl. No.: 10/277,433

(22) Filed: Oct. 22, 2002

(65) Prior Publication Data

US 2003/0080668 A1 May 1, 2003

(30) Foreign Application Priority Data

Oct. 26, 2001 (JP) ..... 2001-328842

(51) Int. Cl.[7] ..... H01J 29/48
(52) U.S. Cl. ..... 313/417; 313/447; 315/98
(58) Field of Search ..... 313/412–414, 313/417, 421, 426, 441, 446, 447, 337, 477 HC, 270; 315/94, 97–98, 101, 105, 106, 107, 99

(56) References Cited

U.S. PATENT DOCUMENTS 5,866,976 A * 2/1999 Iwai et al. ..... 313/447
6,133,786 A * 10/2000 Symons ..... 330/44
6,191,651 B1 * 2/2001 Shrader ..... 330/44
6,509,682 B2 * 1/2003 Ishinagawa et al. .. 313/477 HC

* cited by examiner

*Primary Examiner*—Ashok Patel

(57) ABSTRACT

The present invention provides an electron gun which includes an electrically non-conductive substrate through which a perforation is provided. The electron gun is characterized in that a cathode-structure supporting member is welded to power-feeding members that are bonded to a stem side of the electrically non-conductive substrate, the cathode-structure supporting member supplying power to a heater included in a cathode structure. Structured as such, it becomes possible to reduce the size of the electron gun in the tube-axis direction, since an additional member for supporting the heater becomes unnecessary. In addition, the cathode-structure supporting member makes the electrically non-conductive substrate to work as a wiring board for supplying voltage to the cathode, thereby realizing a slim cathode-ray tube. Further, the above structure improves accuracy in the assembly process of the electron gun, thereby improving the yield factor.

21 Claims, 10 Drawing Sheets

PRIOR ART

ELECTRON GUN HAVING SHORT LENGTH AND CATHODE-RAY TUBE APPARATUS USING SUCH ELECTRON GUN

CROSS-REFERENCE TO RELATED APPLICATIONS

This application is based on application No. 2001-328842 filed in Japan, the contents of which are hereby incorporated by reference.

BACKGROUND OF THE INVENTION

1. Field of the Invention

The present invention relates to an electron gun and a cathode-ray tube, in particular to a technology of shortening a length of the electron gun.

2. Related Art

In recent years, flat display devices such as PDPs (Plasma display panel) and LCD displays have been remarkably prevailed. Accordingly, it is being required to reduce the depth of a cathode-ray tube apparatus used therefor. To solve the mentioned problem, there has been already an attempt to improve a deflection yolk so as to enlarge a deflection angle of the electron beam.

In addition, a technology has been considered to downsize the electron gun, which will lead to downsizing of the length of the cathode-ray tube apparatus. Examples thereof include a structure of the electron gun disclosed in a Japanese Laid-open Patent Application No. H02-056836. Normally, the cathode of the electron gun, the control electrode, and the accelerating electrode are independently fixed to the multi-form glass rod. Whereas the technology disclosed in this patent application fixes these electrodes altogether to the multi-form glass rod, in an attempt to reduce the size of the electron gun. Hereinafter, electrodes that are made up of a cathode of the electron gun, the control electrode, and the accelerating electrode are collectively referred to as "three-electrode part."

FIG. 1 is a sectional diagram showing a structure of the three-electrode part as disclosed in the Japanese Laid-open Patent Application No. H02-056836. The three-electrode part relating to this patent application is made up of a thermal cathode 101, a control electrode 106, and an accelerating electrode 108. A heater 102 that heats the thermal cathode 101 has a long structure in the direction of the tube-axis, whose longitudinal length is approximately 3–5 mm.

The heater 102 is surrounded by a sleeve 103 that is in a tubular form. The sleeve 103 is in turn surrounded and supported by a bush 104, which is also in a tubular form. The bush 104 is fit by insertion to the cathode support 105. Further, the control electrode 106 is provided at a place where it is closer to the screen than the cathode support 105 in a tube-axis direction. An electrically non-conductive spacer 107 is provided at a place where it is closer to the screen than the control electrode 106 in a tube-axis direction.

The accelerating electrode 108 is in a form of a cup. The electrically non-conductive spacer 107, the control electrode 106, and cathode support 105 are arranged to be stored inside the accelerating electrode 108, in this order from the bottom of the accelerating electrode 108. The mentioned members are fixed inside the accelerating electrode 108 by the electrode-pressing member 109 fit by insertion to the accelerating electrode 108.

Here, the heater is supported by a heater supporting hardware 110 inside the sleeve 103, in such a manner that the heater is not in direct contact with the sleeve 103. Structured in the above way, it is possible to keep accurate distances between the electrodes making up the three-electrode part, which helps reducing the size of the length of the electron gun.

However, the length of the electron gun which is from the heater supporting hardware 110 to the accelerating electrode 108 is about 12–20 mm. Further reduction in size of the electron gun is desired for reducing the length of the entire cathode-ray tube apparatus.

SUMMARY OF THE INVENTION

The object of the present invention, in view of the above-described problems, is to provide an electron gun having a reduced length in the direction of the tube-axis, and further to provide a cathode-ray tube apparatus, which includes such electron gun.

In order to solve the stated problems, an electron gun relating to the present invention is characterized by including: an electrically non-conductive member through which a perforation is provided; a cathode structure which is made up of a thermal cathode and a heater; a plurality of power-feeding members that are provided on a side of the electrically non-conductive member, the side being opposite to a side from which the cathode structure emits electron beams; a first cathode-structure supporting member that electrically connects the heater with at least two of the power-feeding members and supports the cathode structure; and a second cathode-structure supporting member that electrically connects the thermal cathode with at least one of the power-feeding members and supports the cathode structure.

Structured in such a way, the cathode structure including the heater and the thermal cathode is supported by the electrically non-conductive member, through the first and second cathode-structure supporting members, the heater being a part of the cathode structure. Therefore, it becomes unnecessary to have such member as the heater supporting hardware 110, thereby reducing an entire length of the electron gun. In addition, the first and second cathode-structure supporting members are used to supply power to the thermal cathode and to the heater, the power having come from the power-feeding members. This even more helps to realize a compact electron gun.

Furthermore, according to the above structure, the distance between the control electrode and the cathode structure is able to be adjusted, in mounting the first and second cathode-structure supporting members to the power-feeding members, where the first and second cathode-structure supporting members have been already mounted to the cathode structure. This makes it possible to realize an electron gun that can be assembled with accuracy. Moreover, the yield factor is improved for producing such electron gun.

In addition, according to the structure, it is possible to cut the first and second cathode-structure supporting members, so as to take out the cathode structure. This facilitates taking the parts apart, thereby promoting recycling use of such parts.

Further, the cathode-ray tube apparatus of the present invention is characterized by a cathode-ray tube apparatus including an electron gun that has: an electrically non-conductive member through which a perforation is provided; a cathode structure which is made up of a thermal cathode and a heater; a plurality of power-feeding members that are provided on a side of the electrically non-conductive member, the side being opposite to a side from which the cathode structure emits electron beams; a first cathode-structure supporting member that electrically connects the heater with at least two of the power-feeding members and supports the cathode structure; and a second cathode-structure supporting member that electrically connects the thermal cathode with at least one of the power-feeding members and supports the cathode structure.

BRIEF DESCRIPTION OF THE DRAWINGS

These and other objects, advantages and features of the invention will become apparent from the following description thereof taken in conjunction with the accompanying drawings which illustrate a specific embodiment of the invention. In the drawings.

DESCRIPTION OF THE PREFERRED EMBODIMENTS

The following describes embodiments of an electron gun and a cathode-ray tube apparatus that relate to the present invention, with reference to the drawings.

1. First Embodiment 1-1. Structure of Cathode-Ray Tube Apparatus

Figure 1:
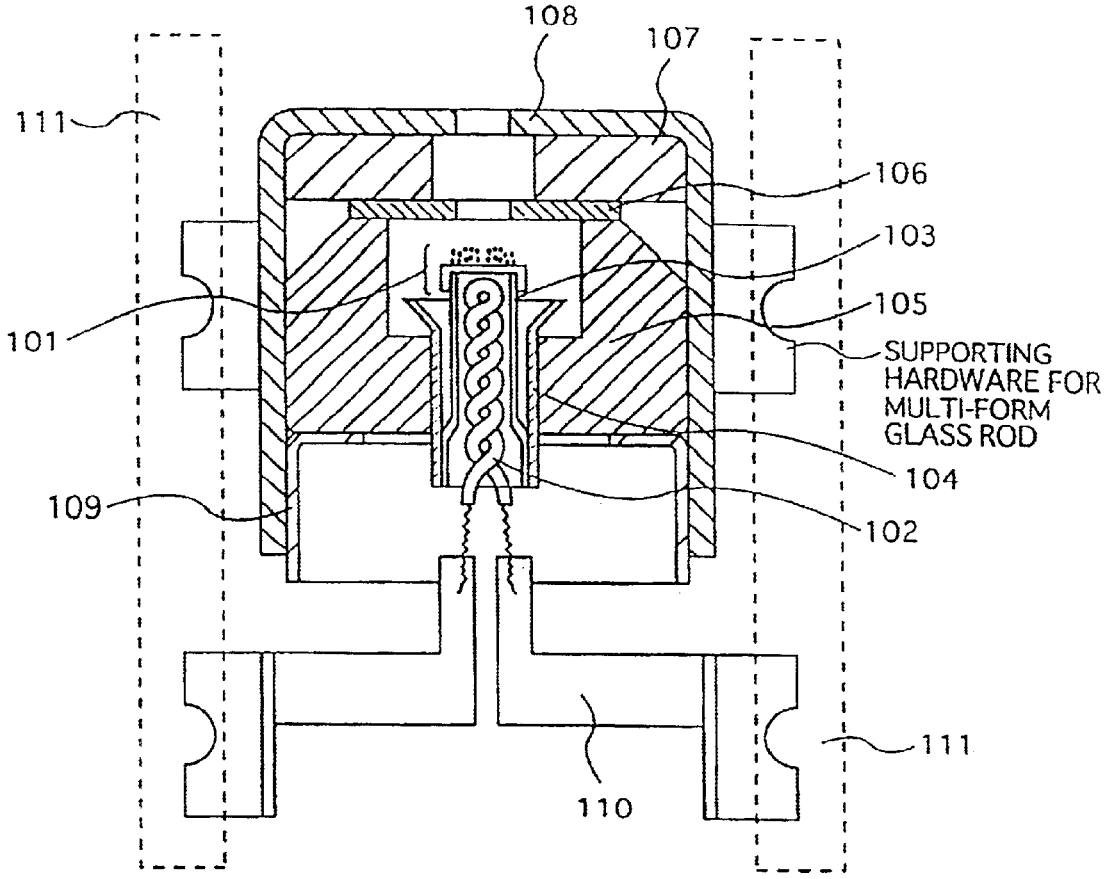
FIG. 1 is a diagram showing a sectional view of an electron gun relating to a conventional technology disclosed in the Japanese Laid-open patent Application H02-056836, especially showing a sectional view of the three-electrode part.
Figure 2:
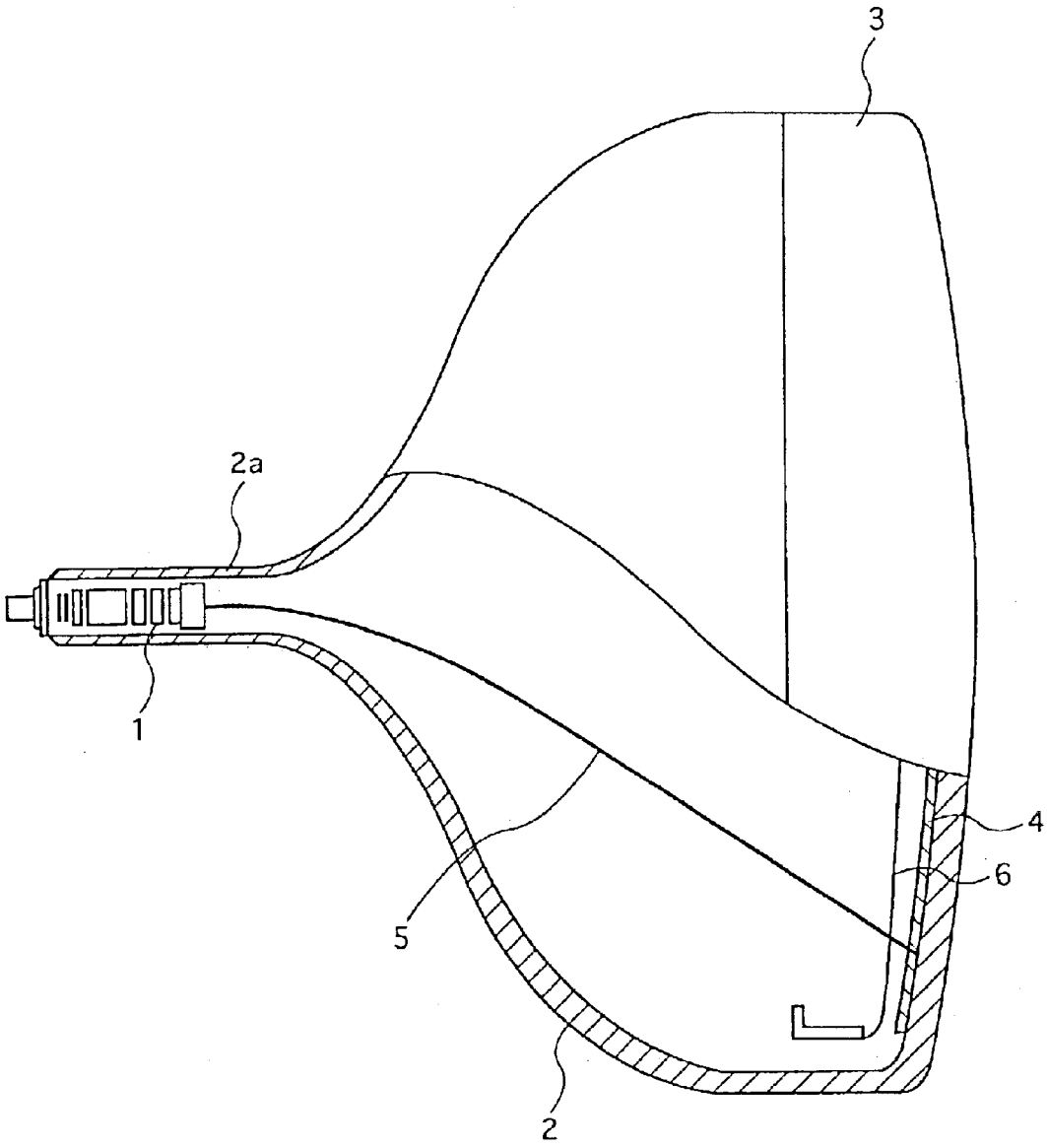
FIG. 2 shows, relating to the first embodiment, a partly broken view of a cathode-ray tube apparatus.

FIG. 2 is a side view of the cathode-ray tube apparatus relating to the first embodiment of the present invention. FIG. 2 is a partly broken view of the cathode-ray tube apparatus. As shown in FIG. 2, the cathode-ray tube apparatus includes an outer apparatus made up of a funnel 2 and a panel 3. An electron gun 1 is stored inside a neck part 2*a* of the funnel 2. And phosphors each having a color of Blue, Green, and Red are applied on the inner surface of the panel 3, so as to form a phosphor screen 4.

An electron gun 1, upon receiving an input signal, emits an electron beam 5 that corresponds to each color of the phosphor. The electron beam 5 goes through a hole formed on a shadow mask 6 to the phosphor screen 4. Upon receiving the electron beam 5, the phosphor screen 4 emits a fluorescent light to display an image on itself.

The electron gun 1 includes a thermal cathode, a control electrode, an accelerating electrode, and other grid electrodes. As explained in the following, the thermal cathode and the control electrode are integrated. Further, the cathode structure including the thermal cathode are integrated along with the electrically non-conductive substrate to collectively form a cathode unit.

1-2 Structure of Cathode Unit and the Like

Figure 3A:
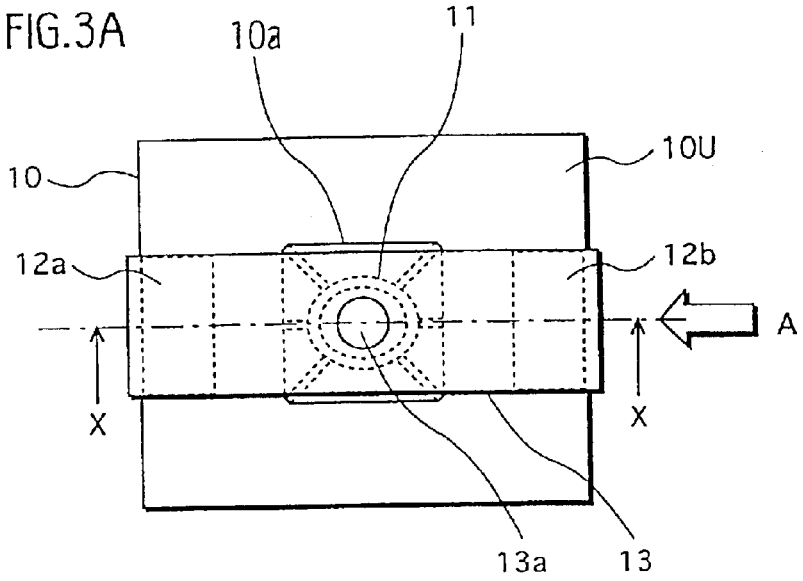
FIG. 3A shows, relating to the first embodiment, a cathode unit and a control electrode that are seen from the side of a phosphor screen 4.
Figure 3B:
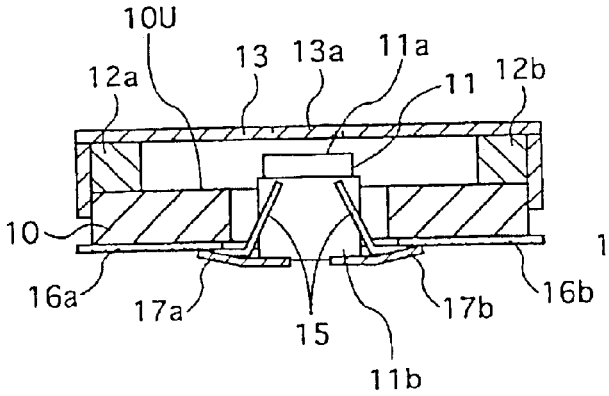
FIG. 3B shows, relating to the first embodiment, a sectional view of the cathode unit and the control electrode that are taken along the line X—X shown in FIG. 3A.
Figure 3C:
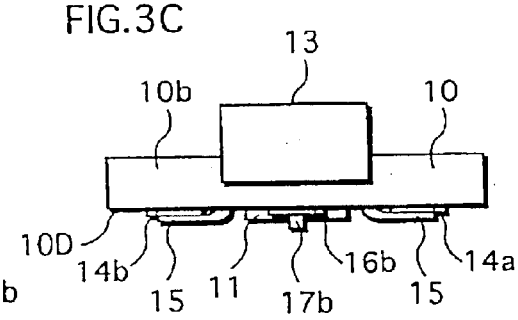
FIG. 3C shows, relating to the first embodiment, a sectional view of the cathode unit and the control electrode, that are seen from the arrow A shown in FIG. 3A.
Figure 3D:
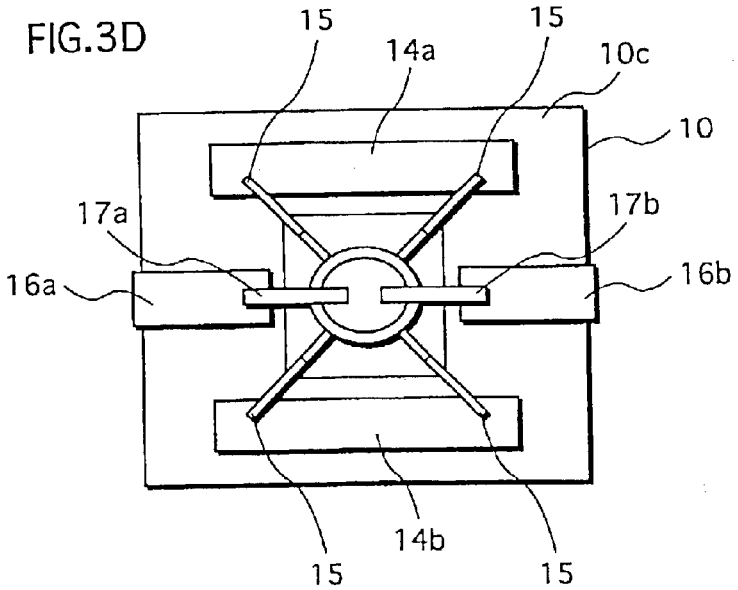
FIG. 3D shows, relating to the first embodiment, the cathode unit and the control electrode, which are seen from the side of a stem.

FIGS. 3A, 3B, 3C, and 3D are diagrams showing a structure of an integrated cathode unit with a control electrode. FIG. 3A is a diagram showing the mentioned members seen from the side of the phosphor screen 4. FIG. 3B is a diagram showing a sectional view of the mentioned members taken along the line X—X. FIG. 3C is a diagram showing the members in FIG. 3A seen from the arrow A. Finally, FIG. 3D shows the members seen from the side of the stem.

As FIGS. 3A and 3B show, the members include an electrically non-conductive substrate 10 which is a flat plate in a rectangular shape. A substantially rectangular-shaped perforation 10*a* is formed in the center of the electrically non-conductive substrate 10. A cathode structure 11 is provided inside the perforation 10*a* in an inserted condition. In this case, the cathode structure 11 is supported in a condition that it is not in direct contact with the electrically non-conductive substrate 10.

In the first embodiment, the size of the electrically non-conductive substrate 10 is 5 mm of length, 5 mm of width, and 1 mm of thickness. Ideally, the thickness of the electrically non-conductive substrate 10 should be as thin as possible, as long as it does not lose its mechanical strength. Arranged to be so thin, the electrically non-conductive substrate 10 can realize a less length in the tube-axis direction. In addition, the shape of the perforation 10*a* may be round, and is not limited to be rectangular.

Figure 4A:
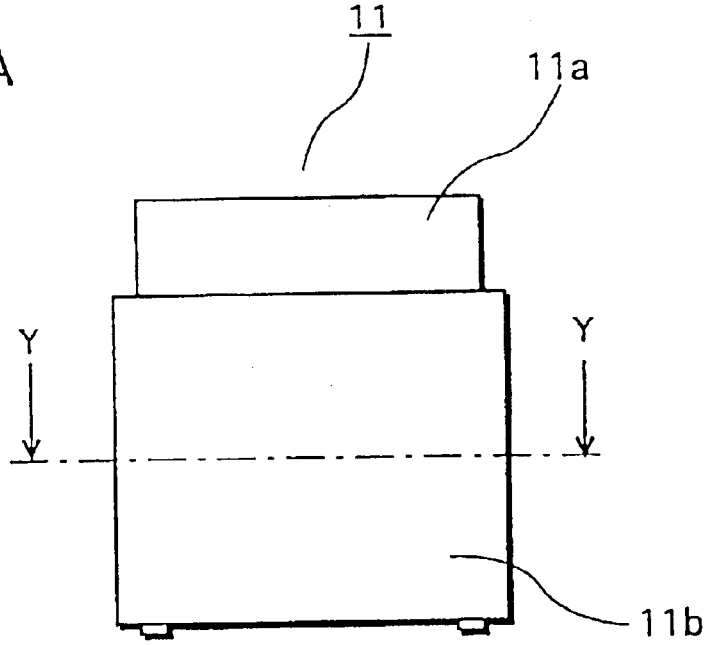
FIG. 4A is a side view of a cathode structure of the electron gun, which relates to the first embodiment.
Figure 4B:
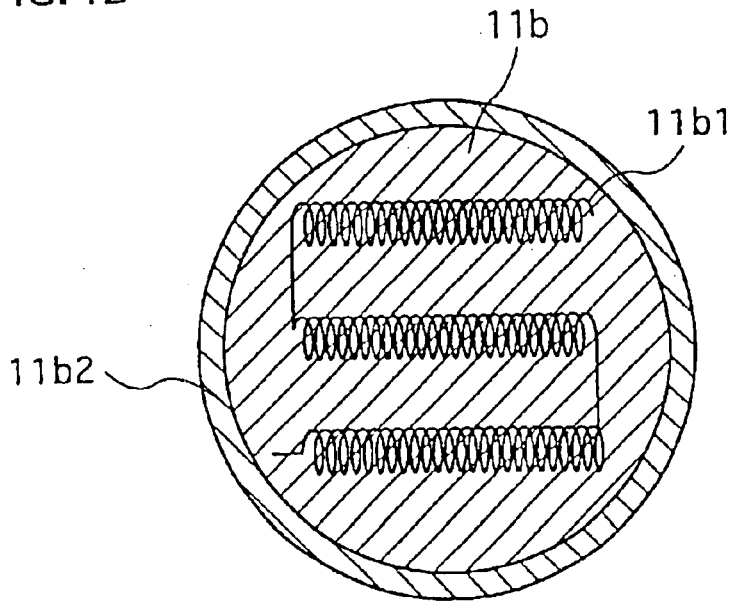
FIG. 4B relates to the first embodiment, and shows a sectional view of a heater of the electron gun which is taken along the line Y—Y in FIG. 4A.

FIGS. 4A and 4B are diagrams showing how a cathode structure 11 is structured. FIG. 4A shows a side view of the cathode structure 11. As shown in FIG. 4A, the cathode structure 11 includes a thermal cathode 11*a* in a shape of a disk, and a heater 11*b* in a columnar form. The thermal cathode 11*a* is an impregnated cathode. The thickness of the thermal cathode 11*a* is 0.5 mm, and the length of the heater 11*b* in the direction of the tube-axis is 2 mm.

FIG. 4B is a diagram showing a sectional view of the heater 11*b* taken along the line Y—Y which is shown in FIG. 4A. As shown in FIG. 4B, the heater 11*b* includes therein an electrically non-conductive block 11*b*2. After alumina powder has been filled within the electrically non-conductive block 11*b*2, the electrically non-conductive block 11*b*2 is sintered. This process fixes the heater coil 11*b*1 in the alumina powder. Therefore when the heater coil 11*b*1 is supplied power, the thermal cathode 11*a* is heated, which results in emission of electrons.

In the first embodiment, the heater coil 11*b*1 is a 0.65 W type heater coil having a voltage of 6.3 V and a current of 100 mA that is substantially made of tungsten and includes a small amount of rhenium. This heater coil is normally used for a cathode-ray tube.

The heater coil 11*b*1 is provided in its bending condition in S-shape when it is seen in a sectional view. Formed in such a way, the length of the cathode unit can be reduced further. Note that the heater coil 11*b*1 can be arranged in any ways as long as it keeps enough heating value, and the material for the heater coil 11*b*1 can be any material too.

As shown in FIG. 3B, arranged on a main surface of the electrically non-conductive substrate 10 on the side of the phosphor screen 4 (hereinafter "first main surface 10U"), are spacers 12*a* and 12*b* in a manner that they oppose each other with the perforation 10*a* in-between. The spacers 12*a* and 12*b* are made of electrically non-conductive material, and are in a shape of a rectangular parallelepiped.

A control electrode 13 in a shape of block C is provided so as to cover the electrically non-conductive substrate 10 and the spacers 12*a* and 12*b*. The control electrode 13 is made from a Kovar alloy (FeNiCo). And an electron-beam perforation 13*a* is provided through the control electrode 13 where it faces against the perforation 10*a*. A main part of the control electrode 13 is parallel to a main surface of the electrically non-conductive substrate 10. The main part of the control electrode 13 has a width of 1.0 mm, a length of 5.2 mm, and a thickness of 0.1 mm. A diameter of the electron-beam perforation 13*a* is 0.5 mm.

If such structure is adopted for the control electrode 13, it becomes unnecessary that the control electrode 13 should have a mechanical strength as large as required for the conventional control electrode. Accordingly, it becomes unnecessary to have ribs or other means for mechanically reinforcing the control electrode. Further, it becomes unnecessary to consider a mechanical strength resulting from the thickness of a control electrode, or a distance between the control electrode and the cathode structure, all of which will help to simplify the structure for the control electrode 13.

As FIGS. 3B, 3C, and 3D show, another main surface of the electrically non-conductive substrate 10 which is closer to a stem (hereinafter "second main surface 10D"), cathode voltage feeding members 14*a* and 14*b* which are in a thin-plate shape are provided to oppose each other, with the perforation 10*a* in-between. The cathode voltage feeding member 14*a* and 14*b* are made from nickel alloy (FeNi) which is a electrically conductive material, and are used for applying cathode voltage to the thermal cathode 11*a*. In the first embodiment, the cathode voltage feeding members 14*a* and 14*b* are each in a shape of a rectangular form in its plan view. The cathode voltage feeding members 14*a* and 14*b* are arranged so that their longitudinal sides sandwich the perforation 10*a* and that their longitudinal sides are in the same direction of the longitudinal direction of the control electrode 13.

As FIG. 3D shows, the cathode voltage feeding member 14*a* is electrically connected to the cathode structure 11, through two cathode supporting members 15. Likewise, the cathode voltage feeding member 14*b* is electrically connected to the cathode structure 11, through two cathode supporting members 15. As clear from the above, the cathode supporting members 15 consist total of four, each being provided having a 90 degree interval therebetween, with a central axis of the cathode structure 11 as a revolution axis. Each cathode supporting member 15 is for applying the voltage to the cathode structure, the voltage having been supplied from the cathode voltage feeding members 14*a* and 14*b*. Each of the cathode supporting members 15 also supports the cathode structure 11 to keep it from contact with the electrically non-conductive substrate 10.

The material for the cathode supporting member 15 is substantially made from tungsten and includes a small amount of rhenium. Tungsten is generally used as a material for impregnated cathodes. The cathode supporting member 15 has a length of 1 mm and a diameter of 0.05 mm. Since tungsten has a high-melting point, it can avoid inconvenience of being melted even if the temperature of the cathode supporting member 15 reaches the operating temperature of the cathode. Furthermore, since the cathode supporting member 15 is made from tungsten, it will be mechanically strong enough to support the cathode structure 11, even if the cathode supporting member 15 is formed in a rod-shape.

Heater voltage feeding members 16*a* and 16*b* are each in a thin-plate. The heater voltage feeding members 16*a* and 16*b* are arranged, on the second main surface 10D, with the perforation 10*a* in-between. The heater voltage feeding members 16*a* and 16*b* are each made of a stainless electrically-conductive material and are used for supplying power to the heater coil 11*b*1.

In the first embodiment, the heater voltage feeding members 16*a* and 16*b* which are each in a rectangular form in its plan view are arranged in line, with the perforation 1*a* in-between on their longitudinal direction. Moreover, the heater voltage feeding members 16*a* and 16*b* are arranged so that their longitudinal direction coincides with the longitudinal direction of the control electrode 13.

The heater voltage feeding members 16*a* and 16*b* are electrically connected to the heater 11*b* through respective heater supporting members 17*a* and 17*b*. The heater supporting members 17*a* and 17*b* are in a shape of rod, and made of electrically conductive material so as to feed electricity to the heater coil 11*b*1. The heater voltage feeding members 16*a* and 16*b* are also used to support the cathode structure 11. Note that it is ideal to lessen the external exposure of the heater coil 11*b*1 as little as possible, in order to reduce the heat loss of the heater 11*b* and also for the mechanical strength thereof.

1-3 Effect

As seen in the above, in the electron gun relating to the first embodiment, the electrically non-conductive substrate 10 and the cathode structure 11 are integral, without having a multi-form glass rod in-between. This reduces the length between the surface of the cathode structure 11 of its stem side to the control electrode 13 of the side of the phosphor screen 4 down to 3 mm or smaller. Therefore, the length of the three-electrode part on the whole can be 5 mm or smaller. As seen in the above, the length of the conventional three-electrode part is 12–20 mm. Compared to this, the first embodiment of the present invention provides a three-electrode part whose length is less than half of a length of the conventional ones. This is a great reduction in length when compared to the conventional ones.

Moreover, being formed as a block C-shape in its sectional view, the control electrode 13 is assured to be fixed to the spacers 12*a* and 12*b*. This makes it possible to integrate the control electrode 13 with the electrically non-conductive substrate 10 with reliability, which further realizes a solid structure of the electron gun on the whole.

1-3-1 Comparison between the Conventional Technique

The present invention is done with paying attention to the following points of the Japanese Laid-open patent In the electron gun relating to the mentioned Japanese patent application, the heater supporting hardware 110 is provided so as to supply power to the heater 102 and to support the heater 102.

In addition, the electrode pressing member 109 is provided on the heater supporting hardware 110 in the three-electrode part of the electron gun. This electrode pressing member 109 is in contact with the accelerating electrode 108, and is at the same potential as the accelerating electrode 108. Considering the voltage to be applied to the accelerating electrode 108 for controlling the electron beam, there is a possibility of occurrence of a short between the heater supporting hardware 110 and the electrode pressing member 109. In order to avoid such short, the heater supporting hardware 110 and the electrode pressing member 109 should be arranged to be placed distant enough in the direction of the tube-axis.

Furthermore, the heater supporting hardware 110 should have a length of 5 mm in its tube-axis direction. The arrangement facilitates a process of mounting the heater supporting hardware 110 to the multi-form glass rod 111 in mounting the electron gun.

Considering all the factors stated in the above, the conventional electron gun has been designed to have a length of 12–20 mm, which is from the heater supporting hardware 110 to the accelerating electrode 108 in the direction of tube-axis.

Still further, considering the voltage to be applied to the thermal cathode 101, a lead-in wire (not shown in the figure) becomes necessary in the vicinity of the sleeve 103 and of the bush 104. In such cases, for avoiding a short between the lead-in wire and the electrode pressing member 109, and between the lead-in wire and the heater supporting hardware 110, these members should be each placed with an adequate interval. This also contributes to lengthen the electron gun.

To summarize, the electron gun disclosed in the Japanese Laid-open Patent Application No. H02-056836 has a three-electrode part which is effective in maintaining an accurate distance between each electrode. However, the electron gun needs improvement for reducing the length of the cathode-ray tube on the whole. This can be said to all types of conventional electron guns, not only to the electron gun disclosed in the mentioned patent application. The present invention, in light of such problem, is an attempt for reducing the size of the electron gun.

Another aspect relating to the patent application is that the circumference of the electrically non-conductive substrate (i.e. cathode support 105) is covered with the accelerating electrode 108 which is made from an electrically conductive material. This structure is typical of the conventional technologies on the whole. This structure has been essential since the material for the electrically non-conductive substrate has conventionally been glass. Since it is impossible to mount a conductive material directly on a substrate made of glass by either method whether welding or soldering, the circumference thereof would be covered with an electrically conductive material.

On the contrary, the circumference of the electrically non-conductive substrate 10 relating to the first embodiment is not covered with an electrically conductive material. As a result, a capacitance will not be resulted between the electrically non-conductive substrate 10 and the cathode. Therefore, the first embodiment can realize an electron gun which has a better response characteristic than the conventional electron guns.

Note that even if the electrically non-conductive substrate 10 has a circumferential area which is covered with an electrically conductive material, the smaller such area, the smaller the capacitance that will be generated. That is, if a part of the circumference of the electrically non-conductive substrate 10 is not covered with an electrically conductive material, a capacitance can be reduced, and the response characteristic of the resulting electron gun will be improved.

1-3-2 Other Advantageous Effects

In addition, the cathode unit of the electron gun relating to the first embodiment has an excellent characteristic as explained in the following. First, the following two advantages will be obtained by arranging the cathode voltage feeding members 14*a* and 14*b*, and the heater voltage feeding members 16*a*, and 16*b* altogether on the second main surface 10D.

The first advantage is that it becomes possible to use the electrically non-conductive substrate 10 as a wiring board. The present embodiment arranges the cathode voltage feeding members 14*a* and 14*b*, together with the heater voltage feeding members 16*a* and 16*b*, on the second main surface 10D. This arrangement prevents the voltage feeding member from outstanding towards the stem. This contributes to shorten the length in the direction of the tube-axis.

The second advantage is that it is possible to maintain an electrically non-conductive state between the cathode voltage feeding members 14*a*, 14*b*, and the heater voltage feeding members 16*a*, 16*b*, even when the vapor from the cathode structure 11 adheres to the first main surface 10U. That is, the cathode voltage feeding members 14*a*, 14*b*, and the heater voltage feeding members 16*a*, 16*b* are arranged all together on the second main surface 10D. This arrangement avoids the vapor from adhering to these materials. This helps avoid the electrically non-conductive state from being lost.

Further, the following three advantages are gained from the structure of positioning the cathode structure 11 inside the perforation 10*a* and distant from the electrically non-conductive substrate 10.

The first advantage is that it becomes possible to adjust the distance between the cathode structure 11 and the control electrode 13, when fixing the cathode structure 11 to the electrically non-conductive substrate 10 with the cathode supporting member 15 in-between. By this adjustment, it becomes possible to further improve the characteristic of the electron gun. Concretely, the adjustment can be performed by calculating the distance between the control electrode 13 and the cathode structure 11, based on the measured capacitance existing therebetween, for example. To realize such adjustment, it is desirable that a form and a size of the perforation 10*a* be such that the cathode structure 11 can freely move in the direction of the tube-axis within the perforation 10*a*.

The second advantage is that since the cathode structure 11 is positioned inside the perforation 10*a*, the length of the electron gun is shortened compared to otherwise. According to this positioning of the cathode structure 11, the length of the electrically non-conductive substrate 10 will not contribute to the entire length of the electron gun, if the electrically non-conductive substrate 10 has a smaller length than the cathode structure 11. When, on contrary, the electrically non-conductive substrate 10 has a larger length than the cathode structure 11, the length of the cathode structure 11 will not contribute to the entire length of the electron gun.

The third advantage is that the heat emitted from the heater 11*b* will not be dissipated through the electrically non-conductive substrate 10, because the cathode structure 11 is kept from the contact of the electrically non-conductive substrate 10. As a result, the thermal cathode will be efficiently heated with a smaller amount of electricity, which will facilitate the emission of the electron beam.

In addition, a part of the electrically non-conductive substrate 10 is made of non-metal and non-conductive material, the part being where the side surface of the metal cathode structure 11 opposes the wall of the perforation 10*a*. Therefore, the capacitance between the cathode structure 11 and the perforation 10*a* will be reduced.

Further, when the electrically non-conductive substrate 10 is formed as a square in the plan view, with its backside shape being identical to the front square shape, the positioning of members required to assemble the electron gun 1 will be facilitated. The mentioned effect can be obtained if the electrically non-conductive substrate 10 is in a symmetrical shape if rotated with an angle of 90 degree, and that its backside shape is identical to the front shape. Accordingly, the productivity will be enhanced, since it is no longer necessary to perform oscillating processes in which parts feeders are used in order for arranging and positioning parts. Still further, it becomes easier to allocate areas to the electrically non-conductive substrate 10 for attaching thereto the cathode voltage feeding members 14*a*, 14*b*, and the heater voltage feeding members.

(Second Embodiment)

Next, a cathode-ray tube apparatus relating to the second embodiment of the present invention is described with reference to the drawings. The cathode-ray tube apparatus of the second embodiment has the substantially same structure as the cathode-ray tube apparatus of the first embodiment. However, the second embodiment has a characteristic in its three-electrode part where a cathode, a control electrode, and an accelerating electrode are integrated. In the following description, the members that have corresponding members in the first embodiment are assigned the same reference numbers as the first embodiment, to facilitate understanding.

Figure 5A:
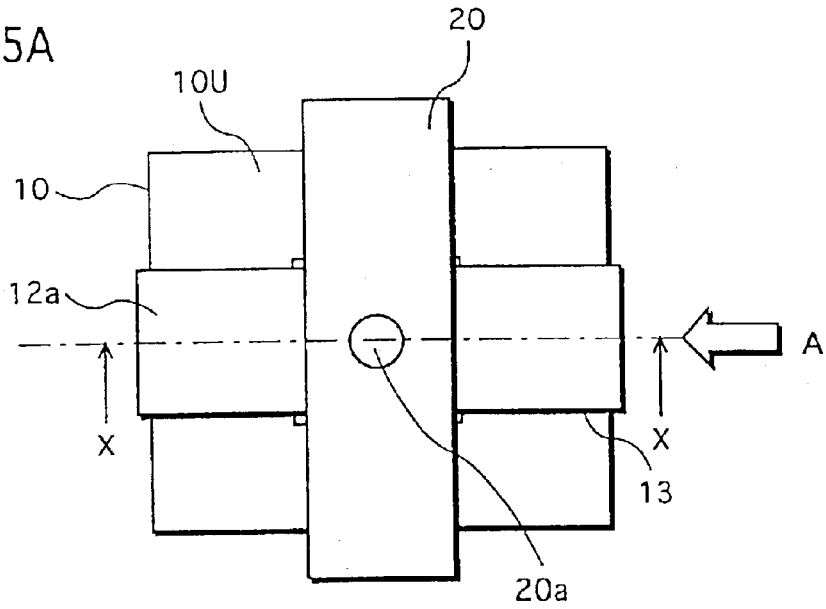
FIG. 5A shows a three-electrode part seen from the side of a phosphor screen 4, which relates to the second embodiment.
Figure 5B:
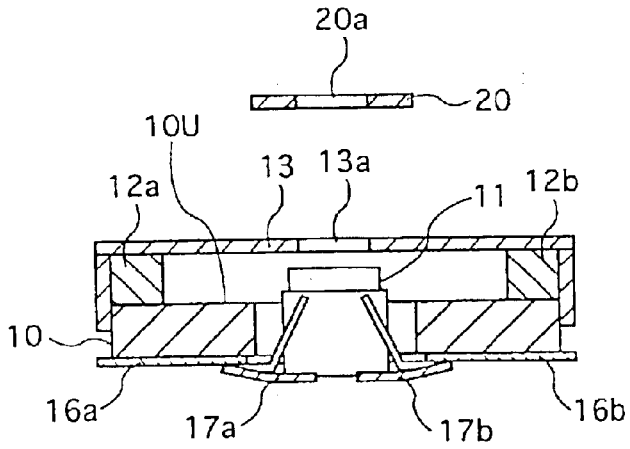
FIG. 5B shows a sectional view of the three-electrode part of the second embodiment which is taken along the line X—X of FIG. 5A.
Figure 5C:
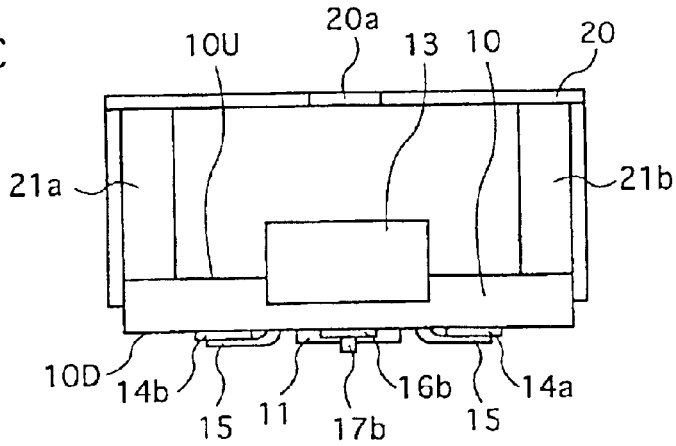
FIG. 5C also shows the three-electrode part of the second embodiment seen from the side of the arrow A shown in FIG. 5A.

FIGS. 5A, 5B, and 5C are diagrams showing an electron gun included in the cathode-ray tube apparatus relating to the second embodiment, with special attention to how the three-electrode part is structured. FIG. 5A shows the three-electrode part seen from the side of a phosphor screen 4. FIG. 5B shows a sectional view of the three-electrode part taken along the line X—X of FIG. 5A. FIG. 5C also shows the three-electrode part seen from the side of the arrow A shown in FIG. 5A.

The three-electrode part of the second embodiment is characterized by having a block C-shape accelerating electrode 20, similar to the shape of the control electrode 13 (compare FIG. 5B with FIG. 3B). The accelerating electrode 20 has a rectangular shape in its plan view. The accelerating electrode 20 has a flat portion which is substantially parallel to the first main surface 10U of an electrically non-conductive substrate 10. And the longitudinal direction of the flat portion is provided substantially perpendicular to the longitudinal direction of the corresponding rectangular portion of the control electrode 13.

On the first main surface 10U, two spacers 21*a* and 21*b* are provided with a perforation 10*a* in-between, as FIGS. 5A, 5B, and 5C show. The spacers 21*a* and 21*b* are made of an electrically non-conductive material and each spacer is in a form of a rectangular solid. The accelerating electrode 20 is mounted so as to sandwich the electrically non-conductive substrate 10, the spacers 21*a*, 21*b* in-between. Note that the accelerating electrode 20 is made of a Kovar alloy (FeNiCo), just as the control electrode 13.

The accelerating electrode 20 is provided therethrough an electron-beam perforation 20*a* having a diameter of 0.5 mm, just as the control electrode 13 having therethrough the electron beam perforation 13*a*. The accelerating electrode 20 has a rectangular portion when viewed from the side of the phosphor screen 4. The sizes for the rectangular portion are width 1.0 mm, the length 5 mm, and the thickness 0.1 mm.

2-1 Effect

Having the above mentioned structure, in the three-electrode part relating to the second embodiment, it becomes easy to adjust the distance between electrodes, in mounting each electrode to the electrically non-conductive substrate 10. This will facilitate an accurate assembly of the three-electrode part. Accordingly, it can improve the yield factor for the three-electrode part. This will help produce an electron gun of high-quality. And the yield factor in production of the electron gun will be improved.

Further, the accelerating electrode, just as the control electrode 13, has a structure of being supported by the spacers 21*a* and 21*b*, which does not require the accelerating electrode 20 itself having such a strong mechanical strength, which does not necessitate a reinforcing material such as ribs. The resulting structure of the accelerating electrode will be simplified.

(Third Embodiment)

Next, a cathode-ray tube apparatus relating to the third embodiment of the present invention is described with reference to the drawing. The cathode-ray tube apparatus relating to the present embodiment has the substantially same structure as that of the first embodiment, with only difference being at the structure of the cathode unit in which a cathode and a control electrode are integrated. In the following description, a member that has the corresponding member in the first embodiment is assigned the same reference number, so as to facilitate understanding.

Figure 6A:
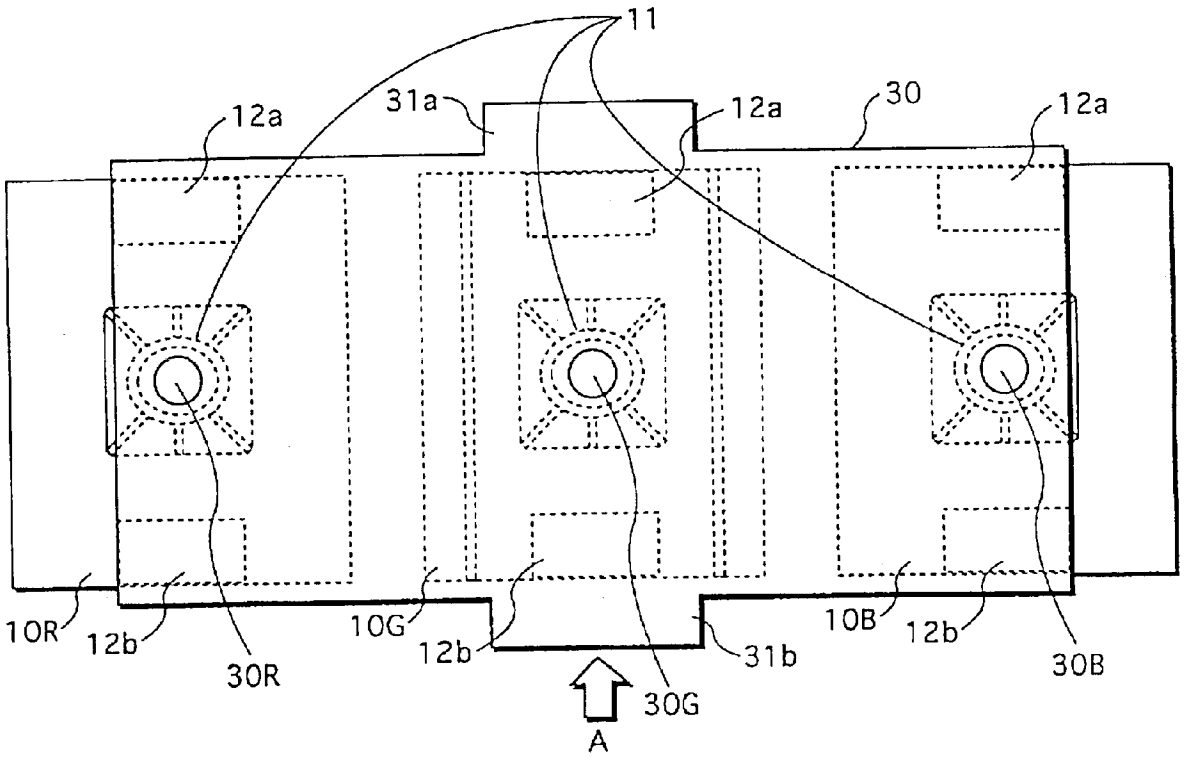
FIG. 6A shows, relating to the third embodiment, a cathode unit and a control electrode that are seen from the side of the phosphor screen 4.
Figure 6B:
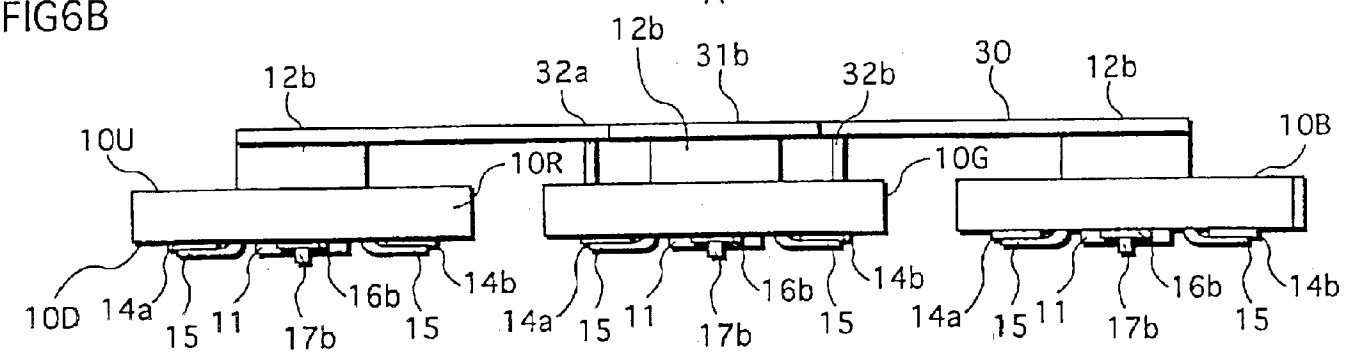
FIG. 6B shows, relating to the third embodiment, the cathode unit and the control electrode that are seen from the arrow A shown in FIG. 6A.

FIGS. 6A, and 6B show the electron gun in the cathode-ray tube apparatus relating to the third embodiment, with special attention to how the cathode unit is structured. FIG. 6A shows the cathode unit seen from the side of the phosphor screen 4; and FIG. 6B shows the cathode unit seen from the arrow A shown in FIG. 6A.

As FIGS. 6A and 6B show, the cathode unit of the third embodiment has a structure of combining three cathode units that each correspond to the three primary colors: red (R); green (G); and blue (B), through a control electrode 30.

As FIGS. 6A and 6B show, the cathode unit includes three electrically non-conductive substrates 1R, 10G, and 10B. Hereinafter, a main surface of each electrically non-conductive substrate on the side of the phosphor screen 4 is respectively called "first main surface 10U." Each first main surface has thereon spacers 12*a* and 12*b*. Each spacer 12*a* and 12*b* is in a form of a rectangular solid, whose longitudinal direction is arranged to coincide with the in-line direction (i.e. a main scanning direction).

Accordingly, each three spacers of the mentioned spacers are aligned on the same side of each electrically non-conductive substrate ("N" side and "S" side). Each three spacers are aligned in-line direction. In addition, the control electrode 30 is made from a Kovar alloy (FeNiCo), and is in a flat-plate shape. The control electrode 30 is also arranged so that its longitudinal direction coincides with the in-line direction. Electron-beam perforations 30R, 30G, and 30B are provided through each area of the control electrode 30 which faces each cathode structure 11 so that electron beams can pass thorough. The electron-beam perforations 30R, 30G, and 30B each have a diameter of 0.5 mm.

In addition, the control electrode 30 has two areas each outstand from both sides of a center portion in the longitudinal direction in a plan view. Hereinafter, the outstanding areas are called "supporting areas 31*a* and 31*b*." The supporting areas 31*a* and 31*b* are used for fixing the cathode unit to the multi-form glass rod. As shown in FIGS. 6A and 6B, supporting members 32*a* and 32*b* are provided on the first main surface 10U of the electrically non-conductive substrate 10G, for preventing the bending of the control electrode 30.

3-1 Effect

As seen in the above, the cathode unit relating to the third embodiment has a structure of combining the electrically non-conductive substrates 10R, 10G, and 10B through the control electrode 30. The stated structure can reduce the length of the electron gun for color picture-tube apparatuses in the tube-axis direction. Accordingly, color picture-tube apparatuses including such electron gun will be reduced in length (depth) in its tube-axis direction.

For other things, since the control electrode 30 is provided with the supporting members 3*la* and 31*b*, the present embodiment does not necessitate additional members for fixing the cathode unit to the multi-form glass rod. This is advantageous in that it can reduce the number of parts for the electron gun. Accordingly, the process time required for the assembly of the electron gun is reduced. In addition, the reduction of the number of assembly steps will help improve the yield factor for the electron gun.

(Fourth Embodiment)

Next, a cathode-ray tube apparatus relating to the fourth embodiment of the present invention is described with reference to the corresponding drawing. The cathode-ray tube apparatus relating to the present embodiment has the substantially same structure as that of the first embodiment, with only difference being at the structure in which the cathode units are integrated, through an accelerating electrode. In the following description, a member that has the corresponding member in the first embodiment is assigned the same reference number, so as to facilitate understanding.

Figure 7A:
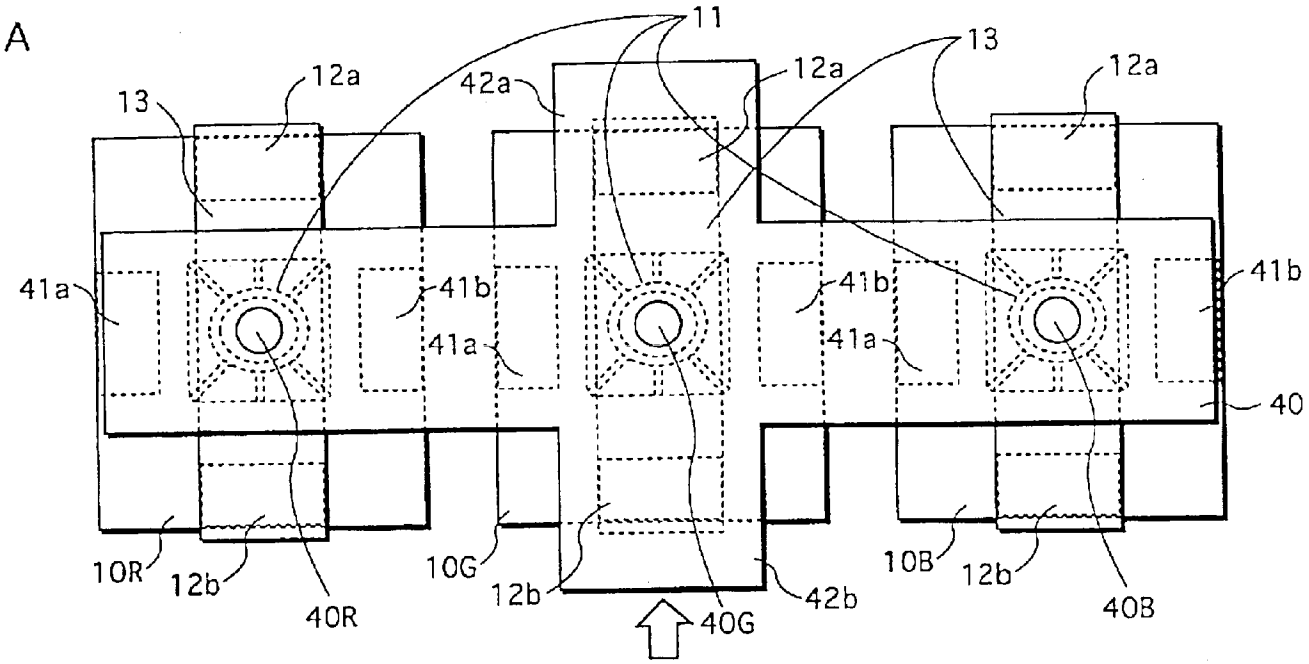
FIG. 7A shows, relating to the fourth embodiment, a three-electrode part seen from the side of a phosphor screen 4.
Figure 7B:
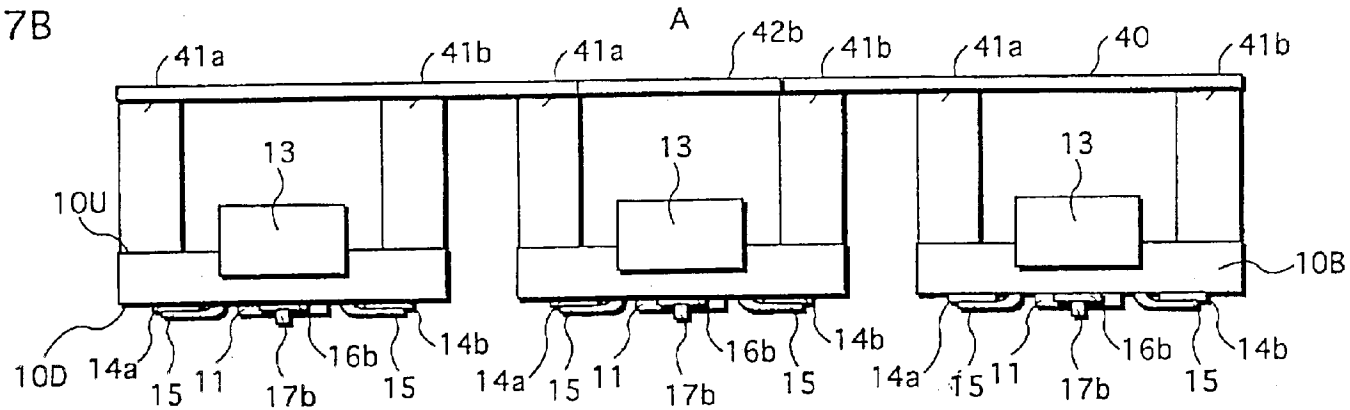
FIG. 7B shows, relating to the fourth embodiment, the three-electrode part seen from an arrow A shown in FIG. 7A.

FIGS. 7A, and 7B show the electron gun in the cathode-ray tube apparatus relating to the fourth embodiment, with special attention to how the three-electrode part is structured. FIG. 7A shows the cathode unit seen from the side of the phosphor screen 4; and FIG. 7B shows the three-electrode part seen from the arrow A shown in FIG. 7A.

As FIG. 7A shows, the three-electrode part of the present embodiment integrates, in itself, three sets of a structure composed of the cathode unit and the control electrode, a set thereof being the same as the one used in the electron gun relating to the first embodiment. The three sets are arranged in the main scanning direction so that their longitudinal direction coincides with the sub-scanning direction. These sets of structures are combined through one accelerating electrode 40 as an integrated structure. Note that the accelerating electrode 40 is provided over first main surfaces 10U of each of the electrically non-conductive substrates: 10R; 10G; and 10B.

On the first main surfaces 10U of each electrically non-conductive substrate 10R, 10G, and 10B, spacers 41*a* and 41*b* are provided to oppose to each other in the sub-scanning direction, with an electron-beam perforation 10*a* in-between. Further, a flat-shaped accelerating electrode 40 is provided over each of the electrically non-conductive substrates 10R, 10G, and 10B, with the spacers 41*a* and 41*b* therebetween.

The accelerating electrode 40 is made of a Kovar alloy (FeNiCo). Electron-beam perforations 40R, 40G, and 40B are provided through the accelerating electrode 40 where it faces against the corresponding electron-beam perforations 10*a*.

A diameter for each of the electron-beam perforations 40R, 40G, and 40B is 0.5 mm.

In addition, the accelerating electrode 40 has two areas each outstand from both sides of a center portion in the longitudinal direction in a plan view. Hereinafter, the outstanding areas are called "supporting areas 42*a* and 42*b*."

4-1 Effect

The electron gun of the present embodiment has a three-electrode part in which three sets of structures each including a cathode structure and a control electrode. Therefore, the three-electrode part on the whole can have a short length in its tube-axis direction. Accordingly, the length (depth) of the color picture-tube apparatus can be reduced.

In addition, it becomes possible to adjust a distance between each electrode in assembling the three-electrode part. This is advantageous in that there will be smaller possibilities of producing defective items whose inter-electrode distance is not adequate, and the resulting electron gun will be of high-quality, and will result in an improved yield factor.

Another advantageous of the present embodiment is that it does not necessitate an additional member for fixing the cathode unit to the multi-form glass rod, since the accelerating electrode 40 has the supporting members 41*a* and 41*b*. This helps reduce the number of parts for the electron gun. Accordingly, the process time required for the assembly of the electron gun is reduced and the number of assembly steps is reduced. These help improve a yield factor in producing an electron gun.

Finally, as described in the above, when the outside shape of the electrically non-conductive substrate 10 is designed to be a square-shape in its plan view, the size of the electron gun in its in-line direction is reduced. This helps realize an electron gun which is more compact in size.

(Fifth Embodiment)

Next, a cathode-ray tube apparatus relating to the fifth embodiment of the present invention is described with reference to the corresponding drawings. The cathode-ray tube apparatus relating to the present embodiment has the substantially same structure as that of the first embodiment, with only difference being at the structure of the cathode unit and the like. In the following description, a member that has the corresponding member in the first embodiment is assigned the same reference number, so as to facilitate understanding.

Figure 8A:
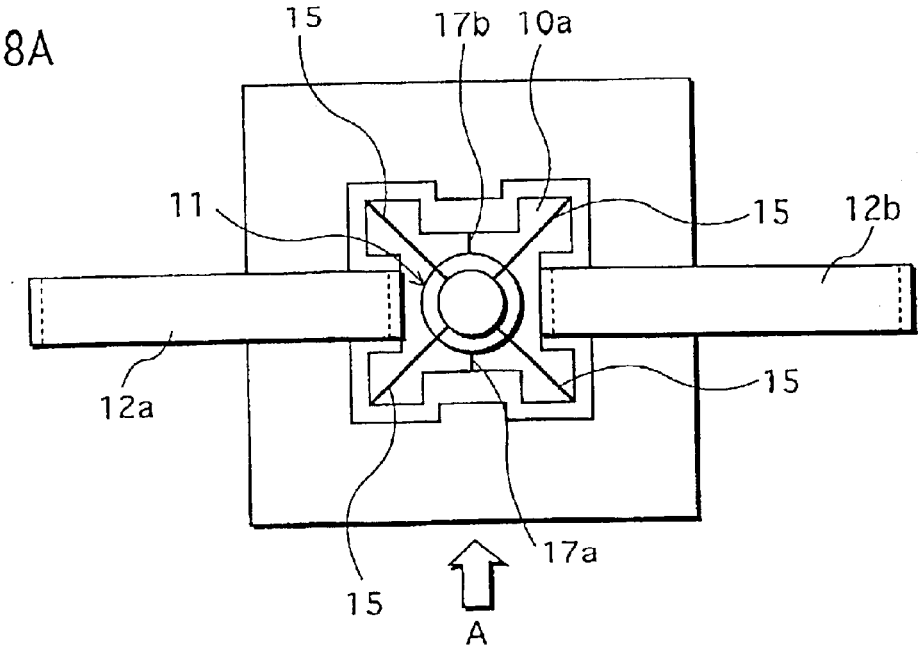
FIG. 8A shows, relating to the fifth embodiment, a cathode unit seen from the side of a phosphor screen 4.
Figure 8B:
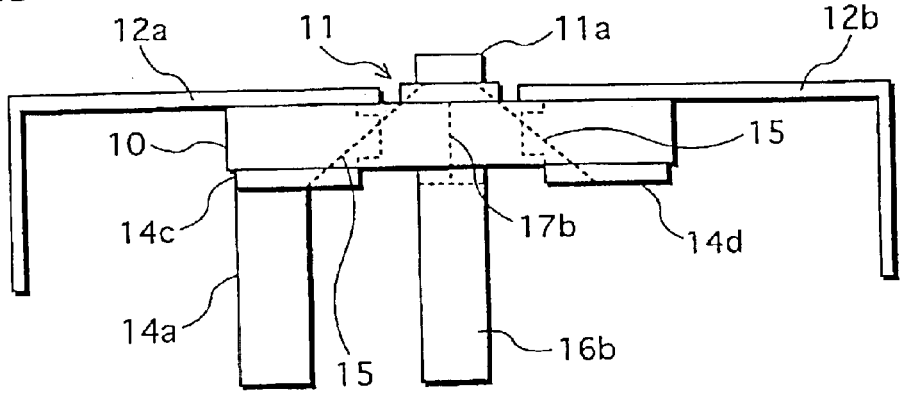
FIG. 8B shows, relating to the fifth embodiment, the cathode unit seen from the arrow A shown in FIG. 8A.
Figure 8C:
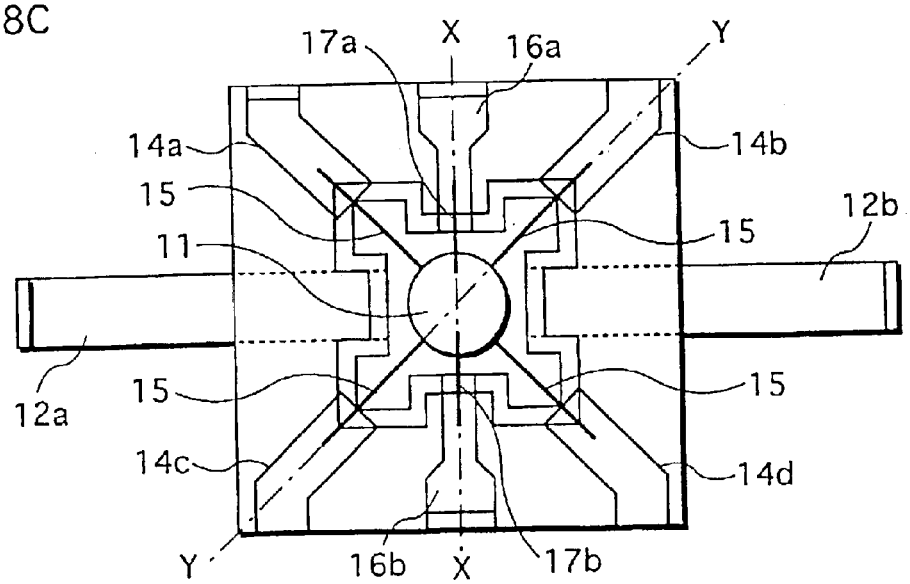
FIG. 8C shows, relating to the fifth embodiment, the cathode unit seen from the side of a stem.

FIGS. 8A, 8B, and 8C show the electron gun in the cathode-ray tube apparatus relating to the fifth embodiment, with special attention to how the cathode unit is structured. FIG. 8A shows the cathode unit seen from the side of the phosphor screen 4; FIG. 8B shows the cathode unit seen from the arrow A shown in FIG. 8A; and FIG. 8C shows the cathode unit seen from the side of the stem.

As FIGS. 8A and 8B show, the cathode unit has an electrically non-conductive substrate 10 which is in a shape of a square in its plan view. A perforation 10*a* is provided through a main surface of the electrically non-conductive substrate 10. In a plan view, the openings of the perforation 10*a* position at the center of the main surfaces. A cathode structure 11 is provided over the opening of the first main surface 10U. In the present embodiment, the perforation 10*a*, in a plan view, is shaped in which the four center portions of each side of a square protrude inwards.

The cathode structure 11 has a disk-shaped thermal cathode 11*a* and a columnar heater 11*b*. Inside the heater 11*b*, a heater coil is sintered together with alumina powder. For the heater coil, the mentioned 0.65 W-type heater coil can be used.

In addition, control electrode-supporting boards 12*a* and 12*b* are attached to the first main surface 10U, so as to oppose to each other, with the perforation 10*a* therebetween. The control electrode-supporting boards 12*a* and 12*b* are made of metal and are in an L-shape. A cup-shape control electrode (not shown in figures) is provided on the control electrode-supporting boards 12*a* and 12*b*, so that the control electrode covers the control electrode-supporting boards 12*a* and 12*b*, and the electrically non-conductive substrate 10.

In such a case, the control electrode-supporting boards 12*a* and 12*b* are each bent at a distant position from where the electrically non-conductive substrate 10 is placed. Therefore there will be a certain interval between the electrically non-conductive substrate 10 and the control electrode. This interval helps reduce capacitance generated between the cathode structure 11 and the control electrode.

As FIGS. 8B and 8C show, in a plan view, cathode voltage feeding members 14*a*–14*d* are provided in the vicinity of the four respective corners of the second main surface 10D of the electrically non-conductive substrate 10. The cathode voltage feeding members 14*a*–14*d* are each in a thin-plate and made of a nickel alloy (FeNi) which is electrically conductive. In a plan view, the cathode voltage feeding members 14*a*–14*d* are narrow and each have a longitudinal direction that coincides with the longitudinal direction of the respective cathode-supporting member 15 connected thereto.

The cathode voltage feeding members 14*a*–14*d* formed in the above way, the areas of the cathode voltage feeding members 14*a*–14*d* are enlarged, which are used to fix the respective cathode-supporting members 15. This helps fix the cathode-supporting members 15 to the cathode voltage feeding members 14*a*–14*d* with reliability. Further, fixing operations such as welding can be made easier, which leads to increased productivity.

Further, by forming the cathode voltage feeding members 14*a*–14*d* in the above fashion, the entire area of the cathode voltage feeding members 14*a*–14*d* is reduced, compared to that of the first embodiment. Accordingly, the capacitance generated between the cathode voltage feeding members 14*a*–14*d* and the other electrodes are to be reduced, which enhances the response characteristic of the resulting electron gun.

As an example, the electron gun of the said Japanese Laid-open Patent Application No. H02-056836 has a capacitance of 4 pF, and that of the first embodiment is 2.6 pF. Whereas the electron gun of the present embodiment has even smaller capacitance which is 1.8 pF.

Further in this embodiment, the perforation 10*a*, in a plan view, is shaped in which the four center portions of each side of a square protrude inwards (hereinafter simply "protruding portion"). This protruding portion prevents the diffusion of the metal vapor such as barium (Ba) having been emitted from the thermal cathode 11*a*, which further prevents the emitted metal vapor from adhering to the cathode-supporting members 15, and to the second main surface 10D of the electrically non-conductive substrate 10. Accordingly, the occurrence of a short is prevented between the electrodes.

In addition, as FIG. 8B shows, a height gap is formed around an opening of the perforation 10*a* which is on the second main surface 10D. Therefore, the vapor deposition of barium and the like on the second main surface 10D is even more prevented. Furthermore, another height gap is formed around another opening of the perforation 10*a* which is on the first main surface 10U. Such height gap will prevent the vapor deposition of barium and the like on the inner wall of the perforation 10*a*. Accordingly, the height gaps prevent a short between the control electrode-supporting boards 12*a* and 12*b* on the first main surface 10U, and the electrodes which are on the second surface 10D.

In addition, as clear from FIG. 8B, the control-electrode supporting boards 12*a*, 12*b* are positioned on one main surface of the electrically non-conductive substrate 10, the main surface being opposite to a main surface on which the cathode voltage feeding members 14*a*–14*d*, the heater voltage feeding members 16*a*, 16*b* are positioned. Structured in such a way, each of the mentioned members are able to be distant from each other, when compared to a case in which the mentioned members are all placed in a same surface of the electrically non-conductive substrate 10. This decreases the capacitance to be generated therebetween.

Another advantage of the present embodiment is that voltage feeding members 14*a*–14*d*, 16*a*, 16*b*, and the control electrode-supporting boards 12*a*, 12*b* are all positioned so that the area that they each overlap in the direction of the tube-axis is as small as possible. In particular, the cathode electrode 14*a*–14*d* do not overlap with the control electrode-supporting boards 12*a*, 12*b* in the tube-axis direction, in any part. The structure is advantageous in that the capacitance to be generated therebetween is reduced in order to enhance the response characteristic of the resulting electron gun.

Figure 9A:
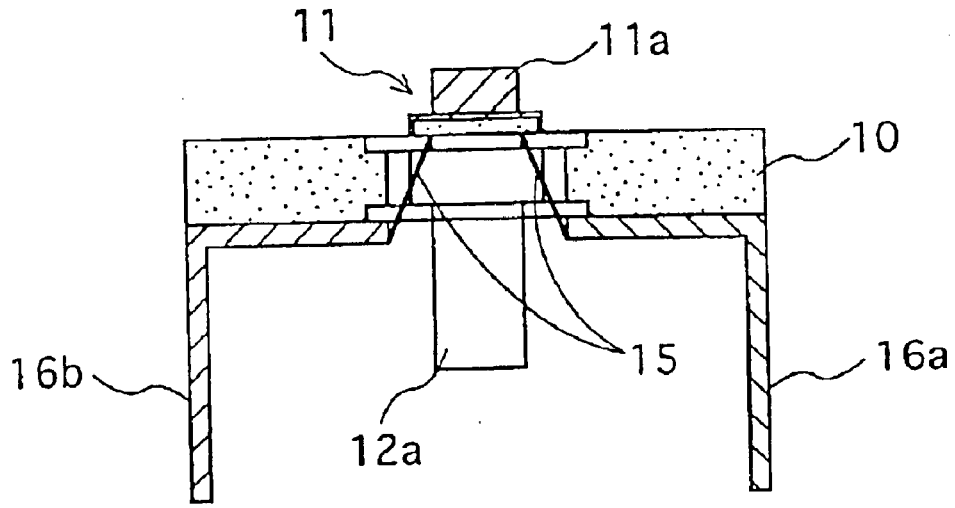
FIG. 9A is a sectional view of the cathode unit of the fifth embodiment, which is taken along the line X—X shown in FIG. 8C.
Figure 9B:
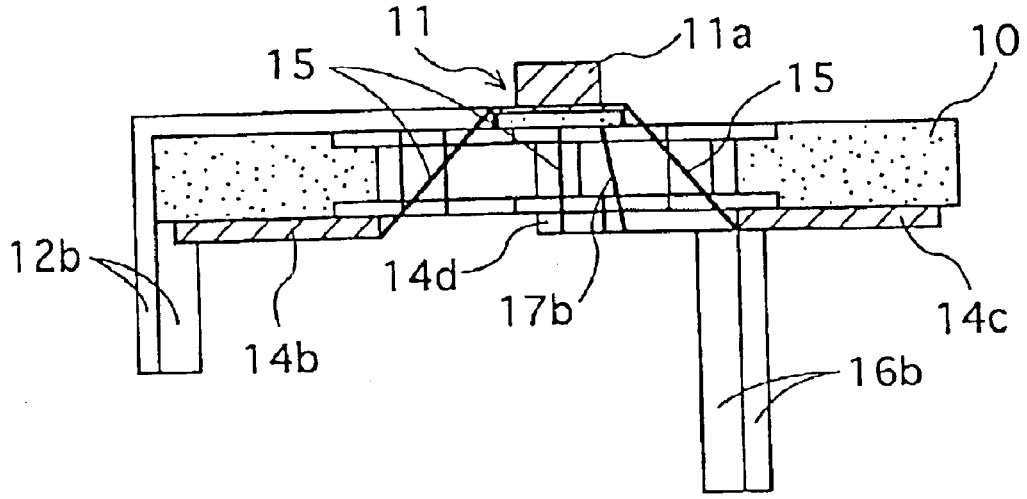
FIG. 9B is a sectional view of the cathode unit relating the fifth embodiment, which is taken along the line Y—Y shown in FIG. 8C.

Next, FIGS. 9A and 9B show a sectional view of the cathode unit relating to the present embodiment; FIG. 9A is a sectional view when taken along the line X—X shown in FIG. 8C; and FIG. 9B is a sectional view taken along the line Y—Y.

As FIGS. 9A and 9B show, each opening part of the perforation 10*a* is lower in level compared to the first main surface 10U or to the second main surface 10D. Designing the opening part of the perforation 10*a* in such a way, a gap will result between the electrically non-conductive substrate 10 and a part of each heater voltage feeding members 16*a*, 16*b* that is closest to the cathode structure 11. The gap will also be generated in other areas in the vicinity of the perforation 10*a*. Examples of the areas include: between the electrically non-conductive substrate 10 and the cathode voltage feeding members 14*a*–14*d*; and between the electrically non-conductive substrate 10 and the control electrode-supporting boards 12*a*, 12*b*.

The mentioned gaps will help reduce the possibility of a short at an area between the control electrode-supporting boards 12*a*, 12*b* and the heater voltage feeding members 16*a*, 16*b*, or between the control electrode-supporting boards 12*a*, 12*b* and the cathode voltage feeding members 14*a*–14*d*. Specifically, the inner wall of the perforation 10*a* tends to catch the metal vapor emitted from the thermal cathode 11*a*, which will produce a metal foil. If such metal foil is produced, the possibility is increased that a short occurs between the mentioned members.

On the other hand, the gaps mentioned in the above will reduce the possibility of producing a metal foil, since the inside these gaps will hardly catch the metal vapor. Therefore, the mentioned gap will reduce the possibility of a short. Further, since the perforation 10*a* now has a longer track along the inner wall of the perforation in a sectional view, compared to a perforation without such gaps. This will prolong the time required for a short to occur, which will prolong the life-span of the electron gun.

It is also possible to form such gaps, by bending the heater voltage feeding members 16*a*, 16*b*, the cathode voltage feeding members 14*a*–14*d*, or the control electrode-supporting boards 12*a*, 12*b*, at parts that are in the vicinity of the perforation 10*a*. The method will produce an identical effect to a method described in the present embodiment.

From the reason stated in the above, the perforation 10*a* is not provided with a conductive material, which will enhance the non-conductiveness. This will further lead to a reduced capacitance and will realize an electron gun which is smaller in size.

The heater voltage feeding members 16*a*, 16*b*, the cathode voltage feeding members 14*a*–14*d*, and the control electrode-supporting boards 12*a*, 12*b* are all made in a same material. Such selection of material helps in welding these materials to a stem pin, since such members all have the same welding condition. This is advantageous since the welding facilities can be simplified, and the welding operation will be simplified, all of which helps efficiently assembling electron guns.

Note that the above advantage can be also said to the welding process of the mentioned members to the electrically non-conductive substrate 10, and further to other attaching methods than welding, such as soldering using silver and the like.

Examples of a material for the heater voltage feeding members 16*a*, 16*b*, the cathode voltage feeding members 14*a*–14*d*, and the control-electrode supporting boards 12*a*, 12*b* include: an stainless alloy; an nickel alloy (FeNi and the like); a Kovar alloy (FeNiCo and the like). In particular, the FeNi (Ni42, Fe bal.) and the Kovar (Ni29, Co17, Mn0.5, Si0.2, Fe Bal.) are two examples that have thermal expansion coefficients that are closer to alumina ceramic. Since alumina ceramic is what the cathode structure is made of, a thermal stress is hard to be generated between the cathode structure and the mentioned members, without depending on the temperature of the thermal cathode, which is another advantage.

(Sixth Embodiment)

Next, a cathode-ray tube apparatus relating to the sixth embodiment is described, with reference to the corresponding drawings. The cathode-ray tube apparatus relating to the present embodiment includes a cathode unit that is a combination of the cathode unit of the first embodiment and that of the fifth embodiment. In the following description, a member that has a corresponding member in the first embodiment is assigned the same reference number.

Figure 10A:
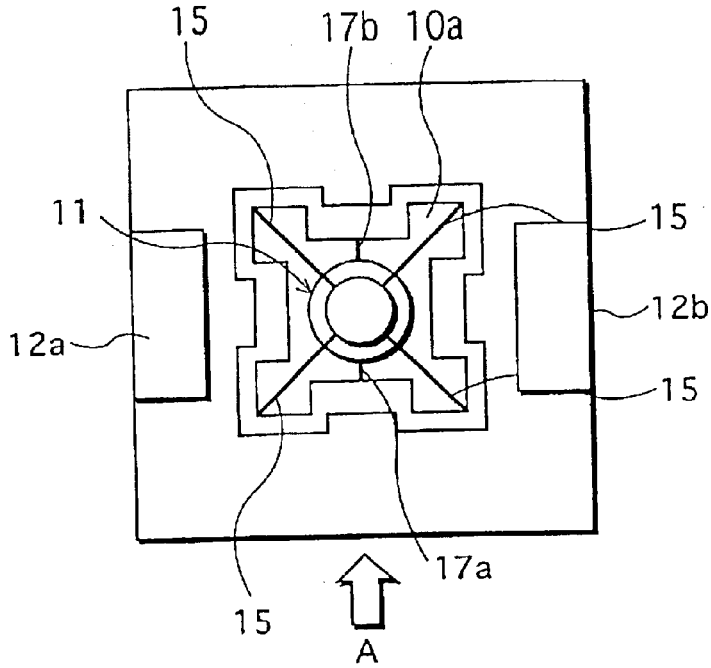
FIG. 10A shows, relating to the sixth embodiment, a cathode unit which is seen from the side of a phosphor screen 4.
Figure 10B:
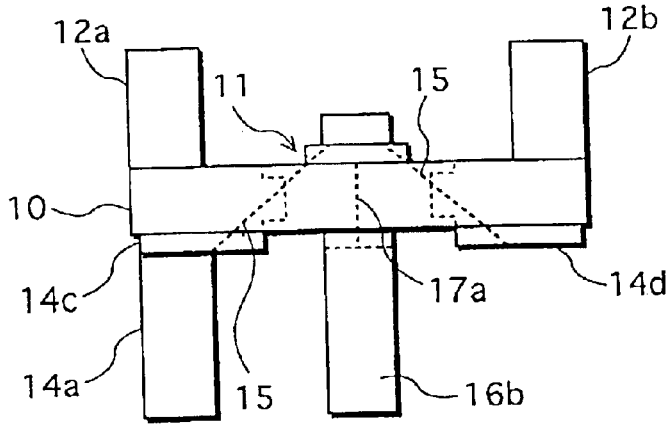
FIG. 10B shows the cathode unit of the sixth embodiment, seen from the arrow A shown in FIG. 8A.
Figure 10C:
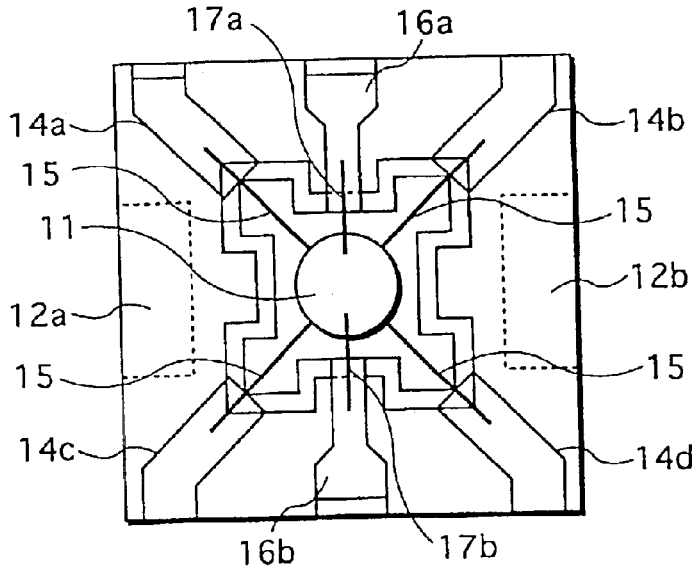
FIG. 10C shows the cathode unit of the sixth embodiment, seen from the side of a stem.

FIGS. 10A, 10B, and 10C are diagrams showing the structure of the cathode unit that the cathode-ray tube apparatus of the present embodiment is equipped with. FIG. 10A is a diagram showing the cathode unit seen from the phosphor screen 4; and FIG. 10B is a diagram showing the cathode unit seen from the side of the arrow A shown in FIG. 10A; and FIG. 10C is a diagram showing the cathode unit seen from the stem side.

As shown in FIGS. 10A and 10B, the cathode unit of the sixth embodiment has the substantially same structure as the cathode unit of the fifth embodiment, with a difference at the spacers 12*a* and 12*b* that are identical as those of the first embodiment. Just as in the first embodiment, a block C-shaped control electrode 13 is arranged so as to cover the spacers 12*a*, 12*b*, and the electrically non-conductive substrate 10 (not shown in the figures).

Structured as in the above, the sixth embodiment can further reduce the length of the cathode unit in the fifth embodiment, in its tube-axis direction, and at the same time attains the same effect as the fifth embodiment. In the fifth embodiment, a cup-shaped control electrode is used. Whereas in the sixth embodiment, a block C-shaped control electrode 13 is used just as the first embodiment. As a result, the sixth embodiment can yield an electron gun has a better response characteristic, with a reduced capacitance between the cathode structure 11 and the control electrode 13.

7. Modifications

This invention so far has been explained on the basis of the preferred embodiments; however, needless to say, the embodiments of this invention are not limited to the ones mentioned above. The following describes other possible modifications.

7-1 Material for Thermal Cathode

In the above embodiments, an impregnated cathode is used. However, an oxide cathode is also applicable, so as to have the same effect.

7-2 Material for Conductive Member

In the above embodiments, each material for members such as the cathode voltage feeding members 14*a*, 14*b*, the cathode supporting member 15, the heater voltage feeding members 16*a*, 16*b*, and the heater supporting members 17*a*, 17*b* may be selected from various metal materials such as stainless steel, a nickel alloy, a Kovar alloy, nickel, nickel chromium, molybdenum, tantalum, tungsten, rhenium, gold, silver, and copper, whatever appropriate for the member. The factors to be considered in the selection of the material are: operating temperature; thermal expansion coefficient; gas absorption characteristic; stiffness; processability; and adhesion property characteristic, and the like.

In addition, the electrically non-conductive substrate 10 is made of ceramics in the above embodiment. However, an electrically non-conductive glass and the like may be used therefor, as long as they have a heat-resistance level of about 500° C. or more, and a non-conductive characteristic.

7-3 Form of the Control Electrode 13

In all the embodiments, the form of the control electrode 13 is block C-shaped in its sectional view. However, the form may also be a flat-plate. In such a case, the control electrode 13 may be fixed to the spacers 12*a*, 12*b* by bonding for example.

Further, the control electrode 13 may be formed in a cup-shape. In such a case, the spacers 12*a* and 12*b* may be used to fix the cup-shaped control electrode to the electrically non-conductive substrate, just as the control electrode 13 is fixed in the described embodiments.

7-4 Number of Cathode Supporting Members

In the embodiments, the number of the cathode supporting members 15 is 4. However, other numbers (i.e. 1 or more) thereof are also possible, as long as the members 15 are able to support the cathode structure 11. It is preferable to have three or more of the cathode supporting members 15 in order to prevent the cathode structure 11 from oscillating.

7-5 Form of the Voltage Feeding Members

In the embodiments, the form for the cathode voltage feeding members 14*a*, 14*b*, and that of the heater voltage feeding members 16*a*, 16*b* are all in a rectangular form in its plan view. However, other forms may be adopted, as long as the members can be electrically connected to the cathode supporting members or to the heater supporting members.

Examples of the other forms include a filament-like form which is bent, or curved.

In the above embodiments, the voltage feeding members are bonded to the electrically non-conductive substrate 10. However, other methods are also possible to fix the members to the electrically non-conductive substrate 10. For example, it is possible to form a concave area on the electrically non-conductive substrate 10 in advance, and to fit the voltage feeding member in the concave area. In such a case, it is important that the voltage feeding member should be electrically connectable to the cathode supporting member 15 or to the heater supporting members 17*a*, 17*b*.

In order to realize such connection, a part of the voltage feeding member can be made to be exposed. Or it equally works to provide a hole through the voltage feeding member so that the cathode supporting member 15 can be inserted into the hole. Further, it is also possible to form a circuit pattern on the electrically non-conductive substrate 10, by etching for example, and use the circuit pattern as the voltage feeding member.

7-6 Method of Fixing the Control Electrode

In the embodiments, the control electrode 13 is fixed to the electrically non-conductive substrate 10 with spacers 12*a* and 12*b* therebetween. However, the following method is also possible. That is, convex areas, in place of the spacers 12*a* and 12*b*, are provided on the first main surface 10U of the electrically non-conductive substrate 10, in order for the control electrode 13 to be fixed to the convex areas. This structure helps reduce a number of parts for the electron gun, which will save effort in assembling the electron gun and the assembly cost will be accordingly reduced.

7-7 Method for Preventing the Control Electrode from Bending

In the third embodiment, supporting members 32*a*, 32*b* are formed on the first main surface 10U of the electrically non-conductive substrate 10G, for preventing the control electrode 30 from bending. However, it is also possible to provide same supporting members 32*a*, 32*b* on each of the electrically non-conductive substrates 10R and 10B, so as to prevent the bending of the control electrode 30 more efficiently. In addition, such effect is enhanced also by increasing the thickness of the control electrode 30, or adopting a stiffer material for the control electrode 30.

7-8 Structure of Electrically Non-Conductive Substrate for Color Electron Gun

In the third and fourth embodiments, an electrically non-conductive substrate is provided according to each of the primary colors. However, it is also possible to have one electrically non-conductive substrate for one electron gun, and providing three perforations through the electrically non-conductive substrate. The perforations are used to mount thereon the cathode structure. This structure is able to prevent the bending of the control electrode 30, and helps produce an electron gun with high accuracy, by controlling the variance of the positions of each cathode structure corresponding to the three primary colors.

7-9 Positioning Method

Conventional material for an electrically non-conductive substrate is glass. It is difficult to precisely form concaves or convexes on a glass substrate. On the other hand, ceramic is used for the material of the electrically non-conductive substrate 10 in the described embodiments.

The electrically non-conductive substrate 10 is easy to precisely form concaves or convexes thereon, or to form precisely perforations through. It is very convenient to use such concaves, convexes, and perforations as a fixing-guide, by fixing thereto other members. For example, if such fixing-guide is used to fix the control electrode to the electrically non-conductive substrate 10, it becomes possible to restrict the eccentricity of the electron beam perforation through the control electrode within a certain range, or to restrict the distance between the cathode and the control electrode within a certain range.

7-10 Arrangement of the Control-Electrode Supporting Boards

In the fifth embodiment, the control-electrode supporting boards 12*a*, 12*b* are provided on one main surface of the electrically non-conductive substrate 10, the main surface being opposite to the surface where the cathode voltage feeding members 14*a*–14*d* and the heater voltage feeding members 16*a*, 16*b* are provided on.

However, it is also possible to provide the control-electrode supporting boards 12*a*, 12*b* on the same surface as where the cathode feeding members 14*a*–14*d*, and the heater voltage feeding members 16*a*, 16*b* are provided. This structure provides all such members on one main surface 10 of the electrically non-conductive substrate 10. This helps simplify the assembly of the cathode unit.

Another effect of having the mentioned members on one main surface of the electrically non-conductive substrate is that the thermal cathode 11*a*, the control-electrode supporting boards 12*a*, 12*b* will be distant to each other with the electrically non-conductive substrate 10 in-between. This helps prevent the metal vapor from the thermal cathode 11*a* from adhering to the control-electrode supporting boards 12*a*, 12*b*, which improves non-conductive characteristic.

Although the present invention has been fully described by way of examples with reference to the accompanying drawings, it is to be noted that various changes and modifications will be apparent to those skilled in the art.

Therefore, unless otherwise such changes and modifications depart from the scope of the present invention, they should be construed as being included therein.

What is claimed is:

1. An electron gun comprising:

an electrically non-conductive member through which a perforation is provided;

a cathode structure which is made up of a thermal cathode and a heater;

a plurality of power-feeding members that are provided on a side of the electrically non-conductive member, the side being opposite to a side from which the cathode structure emits electron beams;

a first cathode-structure supporting member that electrically connects the heater with at least two of the power-feeding members and supports the cathode structure; and a second cathode-structure supporting member that electrically connects the thermal cathode with at least one of the power-feeding members and supports the cathode structure.

2. The electron gun of claim 1, wherein the electrically non-conductive member is a flat-plate, the perforation is provided through the electrically non-conductive member in a thickness direction of the electrically non-conductive member, and the power-feeding members are placed so that a tube-axis direction coincides with a direction of the normal to the power-feeding members.

3. The electron gun of claim 1, wherein the second cathode-structure supporting member is not in contact with an inner surface of the perforation.

4. The electron gun of claim 1, wherein the electrically non-conductive member has at least one area of side surfaces which is not covered with a conductive material.

5. The electron gun of claim 1, further comprising:

a control electrode that is provided over the cathode structure, the control electrode having therethrough a perforation that the electron beams pass through.

6. The electron gun of claim 5, further comprising:

a control-electrode supporting member that is provided on the electrically non-conductive substrate, so as to support the control electrode.

7. The electron gun of claim 6, wherein the control-electrode supporting member is made of a conductive material, and is arranged so as not to overlap with the second supporting member in a tube-axis direction.

8. The electron gun of claim 5, further comprising:

an accelerating electrode that is provided over the cathode structure with the control electrode in-between, the accelerating electrode having therethrough a perforation that the electron beams pass through.

9. The electron gun of claim 8, further comprising:

an accelerating-electrode supporting member that is provided on the electrically non-conductive member, so as to support the accelerating electrode.

10. The electron gun of claim 1, wherein the first cathode-structure supporting member and the at least two of the power-feeding members that are connected thereto are in line, when seen from a tube-axis direction.

11. The electron gun of claim 1, wherein the perforation is provided with a protruding portion on a surface of the electrically non-conductive member, the protruding portion protruding inwards and preventing metal vapor, evaporated from the thermal cathode, from passing through the perforation.

12. The electron gun of claim 11 wherein a plurality of protruding portions protrude inward towards an axis extending through the perforation and aligned with the cathode structure.

13. The electron gun of claim 1, wherein a gap is formed in a vicinity of an opening of the perforation, so as to place the one of the power-feeding members and the electrically non-conductive member at a distance.

14. The electron gun of claim 1, wherein each of the plurality of power-feeding members is made of a same material.

15. The electron gun of claim 14, wherein the material is one of a stainless alloy, a nickel alloy, and a Kovar alloy.

16. The electron gun of claim 1, wherein the plurality of power-feeding members form a circuit pattern on the electrically non-conductive member.

17. The electron gun of claim 1, wherein the electrically non-conductive member is provided thereon at least one concave area, and at least one of the power-feeding members is fit to the concave area.

18. An electron gun comprising:

three electrically non-conductive members that are arranged in an in-line direction, each of the electrically nonconductive members having therethrough a perforation that faces a same direction with each other, each electrically non-conductive member being provided with a cathode structure that is made up of a thermal cathode and a heater, a plurality of power-feeding members that are provided on a side of the electrically non-conductive member, the side being opposite to a side from which the cathode structure emits electron beams, a first cathode-structure supporting member that electrically connects the heater with at least two of the power-feeding members and supports the cathode structure, and a second cathode-structure supporting member that electrically connects the thermal cathode with at least one of the power-feeding members and supports the cathode structure; and a control electrode that is provided over the cathode structures and is provided therethrough three perforations that the electron beams pass through, wherein the cathode structure for each of the three electrically non-conductive members emits electron beams in a same direction with each other.

19. The electron gun of claim 18, further comprising:

three control-electrode supporting members that are each provided on the three electrically non-conductive members.

20. A cathode-ray tube apparatus comprising an electron gun that includes:

an electrically non-conductive member through which a perforation is provided;

a cathode structure which is made up of a thermal cathode and a heater;

a plurality of power-feeding members that are provided on a side of the electrically non-conductive member, the side being opposite to a side from which the cathode structure emits electron beams;

a first cathode-structure supporting member that electrically connects the heater with at least two of the power-feeding members and supports the cathode structure; and a second cathode-structure supporting member that electrically connects the thermal cathode with at least one of the power-feeding members and supports the cathode structure.

21. The cathode-ray tube apparatus comprising an electron gun that includes:

three electrically non-conductive members that are arranged in an in-line direction, each of the electrically non-conductive members having therethrough a perforation that faces a same direction with each other, each electrically non-conductive member being provided with a cathode structure that is made up of a thermal cathode and a heater, a plurality of power-feeding members that are provided on a side of the electrically non-conductive member, the side being opposite to a side from which the cathode structure emits electron beams, a first cathode-structure supporting member that electrically connects the heater with at least two of the power-feeding members and supports the cathode structure, and a second cathode-structure supporting member that electrically connects the thermal cathode with at least one of the power-feeding members and supports the cathode structure; and a control electrode that is provided over the cathode structures and is provided therethrough three perforations that the electron beams pass through, wherein the cathode structure for each of the three electrically non-conductive members emits electron beams in a same direction with each other.

* * * * *

US006828717C1

(12) EX PARTE REEXAMINATION CERTIFICATE (6052nd)

United States Patent

Yamamoto et al.

(10) Number: US 6,828,717 C1

(45) Certificate Issued: Dec. 11, 2007

(54) ELECTRON GUN HAVING SHORT LENGTH AND CATHODE-RAY TUBE APPARATUS USING SUCH ELECTRON GUN

(75) Inventors: Yoji Yamamoto, Nishinomiya (JP); Satoru Nakagawa, Takatsuki (JP); Mika Yamagishi, Takatsuki (JP)

(73) Assignee: Matsushita Electric Industrial Co., Ltd., Kadoma (JP)

Reexamination Request:
No. 90/007,483, Mar. 28, 2005

Reexamination Certificate for:

| | |
|---|---|
| Patent No.: | **6,828,717** |
| Issued: | **Dec. 7, 2004** |
| Appl. No.: | **10/277,433** |
| Filed: | **Oct. 22, 2002** |

(30) Foreign Application Priority Data

Oct. 26, 2001 (JP) ..... 2001-328842

(51) Int. Cl.

| | |
|---|---|
| ***H01J 29/48*** | (2006.01) |
| ***H01J 29/50*** | (2006.01) |
| ***H01J 29/04*** | (2006.01) |

(52) U.S. Cl. ..... 313/417; 313/447; 315/98

(58) Field of Classification Search ..... None
See application file for complete search history.

(56) References Cited

U.S. PATENT DOCUMENTS

| | | | | |
|---|---|---|---|---|
| 3,906,276 A | | 9/1975 | Barraco et al. | |
| 3,914,639 A | | 10/1975 | Barraco et al. | |
| 4,268,775 A | | 5/1981 | Barraco et al. | |
| 5,102,363 A | | 4/1992 | Koizumi | |
| 5,990,637 A | * | 11/1999 | Cho | 315/382 |

FOREIGN PATENT DOCUMENTS

| | | |
|---|---|---|
| JP | 53-14460 | 2/1978 |
| JP | 02-056836 | 2/1990 |
| JP | 09-219140 | 8/1997 |

* cited by examiner

*Primary Examiner*—Margaret Rubin

(57) ABSTRACT

The present invention provides an electron gun which includes an electrically non-conductive substrate through which a perforation is provided. The electron gun is characterized in that a cathode-structure supporting member is welded to power-feeding members that are bonded to a stem side of the electrically non-conductive substrate, the cathode-structure supporting member supplying power to a heater included in a cathode structure. Structured as such, it becomes possible to reduce the size of the electron gun in the tube-axis direction, since an additional member for supporting the heater becomes unnecessary. In addition, the cathode-structure supporting member makes the electrically non-conductive substrate to work as a wiring board for supplying voltage to the cathode, thereby realizing a slim cathode-ray tube. Further, the above structure improves accuracy in the assembly process of the electron gun, thereby improving the yield factor.

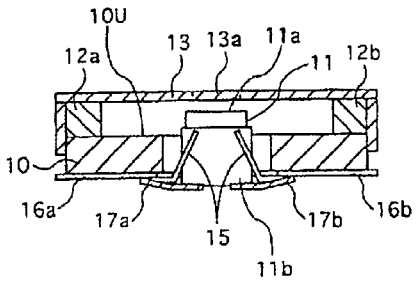

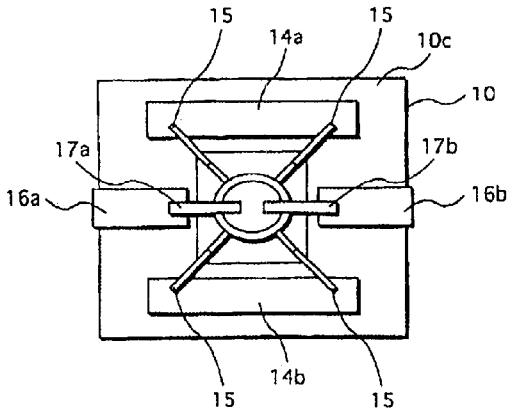

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 5–7, 10–12 and 18–21 are cancelled.

Claims 1 and 8 are determined to be patentable as amended.

Claims 2–4, 9 and 13–17, dependent on an amended claim, are determined to be patentable.

New claims 22–42 are added and determined to be patentable.

1. An electron gun comprising:

an electrically non-conductive member through which a perforation is provided;

a cathode structure which is made up of a thermal cathode and a heater;

a plurality of power-feeding members that are provided on a side of the electrically non-conductive member, the side being opposite to a side from which the cathode structure emits electron beams;

a first cathode-structure supporting member that electrically connects the heater with at least two of the power-feeding members and supports the cathode structure; [and]

a second cathode-structure supporting member that electrically connects the thermal cathode with at least one of the power-feeding members and supports the cathode structure*;*

*a control electrode that is provided over the cathode structure, the control electrode having therethrough a perforation that the electron beams pass through; and*

*a control-electrode supporting member that is provided on the electrically non-conductive substrate, so as to support the control electrode,*

*wherein the control-electrode supporting member is made of a conductive material, and is arranged so as not to overlap with the second cathode-structure supporting member in a tube-axis direction.*

8. The electron gun of claim[5] *1*, further comprising:

an accelerating electrode that is provided over the cathode structure with the control electrode in-between, the accelerating electrode having therethrough a perforation that the electron beams pass through.

*22. The electron gun of claim 1,*

*mounted in a cathode-ray tube apparatus.*

*23. An electron gun comprising:*

*an electrically non-conductive member through which a perforation is provided;*

*a cathode structure which is made up of a thermal cathode and a heater;*

*a plurality of power-feeding members that are provided on a side of the electrically non-conductive member, the side being opposite to a side from which the cathode structure emits electron beams;*

*a first cathode-structure supporting member that electrically connects the heater with at least two of the power-feeding members and supports the cathode structure; and*

*a second cathode-structure supporting member that electrically connects the thermal cathode with at least one of the power-feeding members and supports the cathode structure,*

*wherein the first cathode-structure supporting member and the at least two of the power-feeding members that are connected thereto are in line, when seen from a tube-axis direction.*

*24. The electron gun of claim 23,*

*wherein the electrically non-conductive member is a flat-plate, the perforation is provided through the electrically non-conductive member in a thickness direction of the electrically non-conductive member, and the power-feeding members are placed so that a tube-axis direction coincides with a direction of the normal to the power-feeding members.*

*25. The electron gun of claim 23,*

*wherein the second cathode-structure supporting member is not in contact with an inner surface of the perforation.*

*26. The electron gun of claim 23,*

*wherein the electrically non-conductive member has at least one area of side surfaces which is not covered with a conductive material.*

*27. The electron gun of claim 23,*

*wherein a gap is formed in a vicinity of an opening of the perforation, so as to place the one of the power-feeding members and the electrically non-conductive member at a distance.*

*28. The electron gun of claim 23,*

*wherein each of the plurality of power-feeding members is made of a same material.*

*29. The electron gun of claim 28,*

*wherein the material is one of a stainless alloy, a nickel alloy, and a Kovar alloy.*

*30. The electron gun of claim 23,*

*wherein the plurality of power-feeding members form a circuit pattern on the electrically non-conductive member.*

*31. The electron gun of claim 23,*

*wherein the electrically non-conductive member is provided thereon at least one concave area, and at least one of the power-feeding members is fit to the concave area.*

*32. The electron gun of claim 23*

*mounted in a cathode-ray tube apparatus.*

*33. An electron gun comprising:*

*an electrically non-conductive member through which a perforation is provided;*

*a cathode structure which is made up of a thermal cathode and a heater;*

*a plurality of power-feeding members that are provided on a side of the electrically non-conductive member, the side being opposite to a side from which the cathode structure emits electron beams;*

*a first cathode-structure supporting member that electrically connects the heater with at least two of the*

*power-feeding members and supports the cathode structure; and*

*a second cathode-structure supporting member that electrically connects the thermal cathode with at least one of the power-feeding members and supports the cathode structure,*

*wherein a plurality of protruding portions protrude inward towards an axis extending through the perforation and aligned with the cathode structure.*

*34. The electron gun of claim 33,*

*wherein the electrically non-conductive member is a flat-plate, the perforation is provided through the electrically non-conductive member in a thickness direction of the electrically non-conductive member, and the power-feeding members are placed so that a tube-axis direction coincides with a direction of the normal to the power-feeding members.*

*35. The electron gun of claim 33,*

*wherein the second cathode-structure supporting member is not in contact with an inner surface of the perforation.*

*36. The electron gun of claim 33,*

*wherein the electrically non-conductive member has at least one area of side surfaces which is not covered with a conductive material.*

*37. The electron gun of claim 33,*

*wherein a gap is formed in a vicinity of an opening of the perforation, so as to place the one of the power-feeding members and the electrically non-conductive member at a distance.*

*38. The electron gun of claim 33,*

*wherein each of the plurality of power-feeding members is made of a same material.*

*39. The electron gun of claim 38,*

*wherein the material is one of a stainless alloy, a nickel alloy, and a Kovar alloy.*

*40. The electron gun of claim 33,*

*wherein the plurality of power-feeding members form a circuit pattern on the electrically non-conductive member.*

*41. The electron gun of claim 33,*

*wherein the electrically non-conductive member is provided thereon at least one concave area, and at least one of the power-feeding members is fit to the concave area.*

*42. The electron gun of claim 33,*

*mounted in a cathode-ray tube apparatus.*

* * * * *